US010748490B2

(12) United States Patent
Xu et al.

(10) Patent No.: US 10,748,490 B2
(45) Date of Patent: Aug. 18, 2020

(54) ORGANIC LIGHT EMITTING DIODE (OLED) COMPENSATION CIRCUIT, DISPLAY PANEL AND DISPLAY APPARATUS

(71) Applicant: WUHAN TIANMA MICRO-ELECTRONICS CO., LTD., Wuhan (CN)

(72) Inventors: Haojie Xu, Shanghai (CN); Xingyao Zhou, Shanghai (CN); Yue Li, Shanghai (CN); Yana Gao, Shanghai (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/376,050

(22) Filed: Apr. 5, 2019

(65) Prior Publication Data

US 2020/0074927 A1 Mar. 5, 2020

(30) Foreign Application Priority Data

Aug. 31, 2018 (CN) ..... 2018 1 1010765

(51) Int. Cl.
*G09G 3/3258* (2016.01)

(52) U.S. Cl.
CPC ..... *G09G 3/3258* (2013.01); *G09G 2300/043* (2013.01); *G09G 2300/0426* (2013.01);
(Continued)

(58) Field of Classification Search
CPC ..... G09G 2300/043; G09G 2300/0842; G09G 2300/0847; G09G 3/3258; G09G 2320/02;
(Continued)

(56) References Cited

U.S. PATENT DOCUMENTS

2013/0050292 A1* 2/2013 Mizukoshi ..... G09G 3/3291 345/690
2013/0140537 A1* 6/2013 Ha ..... H01L 27/3262 257/40

(Continued)

FOREIGN PATENT DOCUMENTS

CN 103578426 A 2/2014
CN 103903556 A 7/2014

(Continued)

*Primary Examiner* — Dong Hui Liang

(74) *Attorney, Agent, or Firm* — Anova Law Group PLLC

(57) ABSTRACT

An organic light-emitting diode (OLED) compensation circuit, a display panel and a display apparatus are provided. The OLED compensation circuit includes a first transistor, a second transistor, a third transistor, a fourth transistor, a storage capacitor and an OLED element. For the first transistor, a gate electrode is electrically connected to a first scanning signal line, a first electrode electrically connected to a data signal line, and a second electrode electrically connected to a first node. For the second transistor, a gate electrode is electrically connected to a first light-emitting control signal line, a first electrode electrically connected to a first voltage signal line, and a second electrode electrically connected to a second node. For the third transistor, a gate electrode is electrically connected to the first node, a first electrode electrically connected to the second node, and a second electrode electrically connected to a third node.

16 Claims, 16 Drawing Sheets

(52) U.S. Cl.
CPC ..... *G09G 2300/0842* (2013.01); *G09G 2320/0233* (2013.01)

(58) Field of Classification Search
CPC ..... G09G 2320/0233; G09G 2320/045; H01L 27/3276; H01L 27/3265; H01L 27/3262; H01L 27/10852; H01L 27/10808; H01L 28/60
See application file for complete search history.

(56) References Cited

U.S. PATENT DOCUMENTS

| | | | | |
|---|---|---|---|---|
| 2014/0139510 | A1* | 5/2014 | Han | G09G 3/3291 345/212 |
| 2016/0203764 | A1* | 7/2016 | In | G09G 3/3225 345/215 |

FOREIGN PATENT DOCUMENTS

| | | | |
|---|---|---|---|
| CN | 107134258 | A | 9/2017 |
| CN | 107680527 | A | 2/2018 |

* cited by examiner

ORGANIC LIGHT EMITTING DIODE (OLED) COMPENSATION CIRCUIT, DISPLAY PANEL AND DISPLAY APPARATUS

CROSS-REFERENCES TO RELATED APPLICATIONS

This application claims the priority of Chinese Patent Application No. 201811010765.8 filed on Aug. 31, 2018, the entire contents of which are incorporated herein by reference.

FIELD OF THE DISCLOSURE

The present disclosure generally relates to the field of display technology and, more particularly, relates to an organic light-emitting diode (OLED) compensation circuit, a display panel and a display apparatus.

BACKGROUND

With the development of display technology, liquid crystal display (LCD) and organic light-emitting diode (OLED) display, as two of the mainstream display devices, have been widely utilized in various types of portable electronic devices.

While an LCD display is a non-self-illuminating device, an OLED element is a self-illuminating device. Furthermore, an OLED display possesses faster response, higher contrast as well as wider viewing angle, therefore, it has been more and more valued.

The existing technologies utilize pixel driving circuits to drive an OLED element for light emitting.

Since the luminance of an OLED is related to the current flowing through the OLED, the electrical property of a driving thin-film transistor (TFT) in the pixel-driving circuit may directly impact the display effect. Specifically, the threshold voltage of the thin-film transistor may often drift, thereby causing unevenness in the brightness of the entire OLED display device. To improve the display effect of the OLED, pixel compensation has been commonly applied to the OLED by the use of the pixel driving circuit.

Generally, existing pixel driving circuits have complex circuit structures, which may increase the manufacture cost.

BRIEF SUMMARY OF THE DISCLOSURE

One aspect of the present disclosure provides a OLED compensation circuit, including: a first transistor, a second transistor, a third transistor, a fourth transistor, a storage capacitor and an OLED element. A gate electrode of the first transistor is electrically connected to a first scanning signal line, a first electrode of the first transistor is electrically connected to a data signal line, and a second electrode of the first transistor is electrically connected to a first node. A gate electrode of the second transistor is electrically connected to a first light-emitting control signal line, a first electrode of the second transistor is electrically connected to a first voltage signal line, and a second electrode of the second transistor is electrically connected to a second node. A gate electrode of the third transistor is electrically connected to the first node, a first electrode of the third transistor is electrically connected to the second node, and a second electrode of the third transistor is electrically connected to a third node. A gate electrode of the fourth transistor is electrically connected to a first control signal line, a first electrode of the fourth transistor is electrically connected to a sensing signal line, and a second electrode of the fourth transistor is electrically connected to the second node. A first plate of the storage capacitor is electrically connected to the first node, and a second plate of the storage capacitor is electrically connected to the second node. A first electrode of the OLED element is electrically connected to the third node, and a second electrode of the OLED element is electrically connected to a second voltage signal line.

Another aspect of the present disclosure also provides a display panel, including a substrate, a semiconductor layer of a first transistor disposed on the substrate, a semiconductor layer of a second transistor disposed on the substrate, a semiconductor layer of a third transistor disposed on the substrate, a semiconductor layer of a fourth transistor disposed on the substrate, and a gate insulating layer covering the semiconductor layer of the first transistor, the semiconductor layer of the second transistor, the semiconductor layer of the third transistor and the semiconductor layer of the fourth transistor. A gate electrode of the first transistor is disposed on the gate insulating layer and overlapped with the semiconductor layer of the first transistor. A gate electrode of the second transistor is disposed on the gate insulating layer and overlapped with the semiconductor layer of the second transistor. A gate electrode of the third transistor is disposed on the gate insulating layer and overlapped with the semiconductor layer of the third transistor. A gate electrode of the fourth transistor is disposed on the gate insulating layer and overlapped with the semiconductor layer of the fourth transistor. A first plate of a storage capacitor is disposed on the substrate and overlapped with the gate electrode of the third transistor. An auxiliary insulating layer covers the gate electrode of the first transistor, the gate electrode of the second transistor, the gate electrode of the third transistor, the gate electrode of the fourth transistor and the first plate of the storage capacitor. A second plate of the storage capacitor is disposed on the substrate and overlapped with the first plate of the storage capacitor. An interlayer insulating layer covers the second plate of the storage capacitor. A first scanning signal line is disposed on the substrate, extending along a first direction. A data signal line is disposed on the substrate, extending along a second direction, where the second direction intersects with the first direction. A first light-emitting control signal line is disposed on the substrate, extending along the first direction. A first voltage signal line is disposed on the substrate, extending along the second direction. A first control signal line is disposed on the substrate, extending along the first direction. A sensing signal line is disposed on the substrate, extending along the second direction. The gate electrode of the first transistor is electrically connected to the first scanning signal line, a first electrode of the first transistor is electrically connected to the data signal line, and a second electrode of the first transistor is electrically connected to the first plate of the storage capacitor. The gate electrode of the second transistor is electrically connected to the first light-emitting control signal line, a first electrode of the second transistor is electrically connected to the first voltage signal line, and a second electrode of the second transistor is electrically connected to the second plate of the storage capacitor. The gate electrode of the third transistor is electrically connected to the first plate of the storage capacitor and a first electrode of the third transistor is electrically connected to the second plate of the storage capacitor. The gate electrode of the fourth transistor is electrically connected to the first control signal line, a first electrode of the fourth transistor is electrically connected to the sensing signal line, and a second electrode of the fourth transistor is electrically connected to the second plate of the storage capacitor.

Another aspect of the present disclosure also provides a display apparatus including a display panel provided in the present disclosure.

Other features and advantages of the present disclosure will become more apparent via a reading of detailed descriptions of the non-limiting embodiments with reference to the accompanying drawings.

BRIEF DESCRIPTION OF THE DRAWINGS

The accompanying drawings, illustrating some embodiments of the present disclosures, constitute a part of the present disclosure. These accompanying drawings together with some of the embodiments will be described in the following to illustrate the technical solutions of the present disclosure.

DETAILED DESCRIPTION

Figure 1:
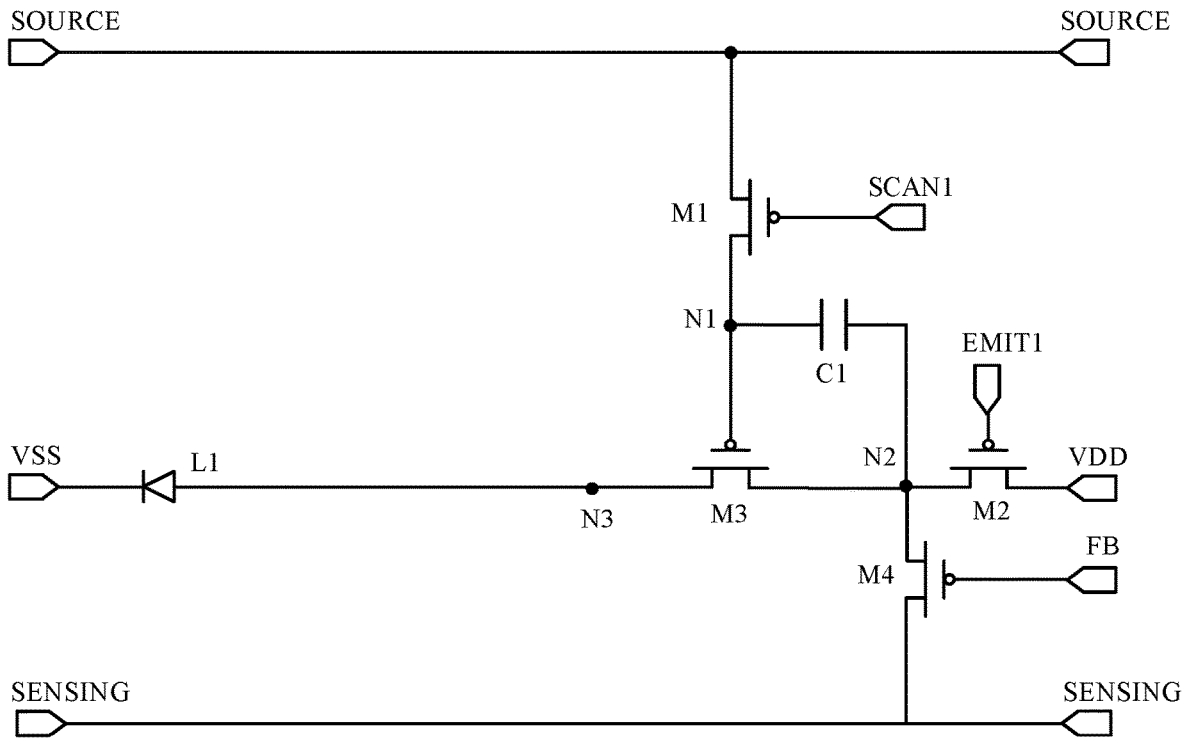
FIG. 1 illustrates a circuit schematic diagram of an exemplary OLED compensation circuit according to various embodiments of the present disclosure.

Various embodiments of the present disclosure will be described in detail as follows with reference to the accompanying drawings. It should be noted that the arrangements of the elements and steps as described in these embodiments, as well as the numeric expressions and numeric values are not intended to limit the scope of the present disclosure, unless otherwise specified.

It should be understood that the description of the exemplary embodiments in the present disclosure are merely for illustrative purposes, not intended to limit any scope of the present disclosure or its implementation.

The technologies, methods and devices that are known to one with ordinary skill in the art will not be described in detail herein, however under certain circumstances, any technology, method and device as disclosed herein should be viewed as part of the present disclosure.

Any numeric value described in exemplary embodiments of the present disclosure is only for illustrative purpose, not intended to be limiting. Accordingly, different numeric values may be applied in other exemplary embodiments of the present disclosure.

It should be noted that similar reference numerals and letters indicate similar items in the following drawings. Hence, once an item is defined in one drawing, it may be unnecessary for the item to be further discussed in subsequent drawings.

The present disclosure provides an organic light-emitting diode (OLED) compensation circuit, a display panel and a display apparatus. The OLED compensation circuit includes a first transistor, a second transistor, a third transistor, a fourth transistor, a storage capacitor and an OLED element. For the first transistor, a gate electrode is electrically connected to a first scanning signal line, a first electrode is electrically connected to a data signal line, and a second electrode is electrically connected to a first node. For the second transistor, a gate electrode is electrically connected to a first light-emitting control signal line, a first electrode is electrically connected to a first voltage signal line, and a second electrode is electrically connected to a second node. For the third transistor, a gate electrode is electrically connected to the first node, a first electrode is electrically connected to the second node, and a second electrode is electrically connected to a third node. For the fourth transistor, a gate electrode is electrically connected to a first control signal line, a first electrode is electrically connected to a sensing signal line, and a second electrode is electrically connected to the second node. The OLED compensation circuit of the present disclosure may possess a function of external compensation which may improve the performance of the circuit.

FIG. 1 illustrates a circuit schematic diagram of an exemplary OLED compensation circuit according to various embodiments of the present disclosure. The present disclosure provides an OLED compensation circuit includes a first transistor M1, a second transistor M2, a third transistor M3, a fourth transistor M4, a storage capacitor C1 and an OLED element L1.

A gate electrode of the first transistor M1 is electrically connected to a first scanning signal line SCAN1, a first electrode of the first transistor M1 is electrically connected to a data signal line SOURCE, and a second electrode of the first transistor M1 is electrically connected to a first node N1.

A gate electrode of the second transistor M2 is electrically connected to a first light-emitting control signal line EMIT1, a first electrode of the second transistor M2 is electrically connected to a first voltage signal line VDD, and a second electrode of the second transistor M2 is electrically connected to a second node N2.

A gate electrode of the third transistor M3 is electrically connected to the first node N1, a first electrode of the third transistor M3 is electrically connected to the second node N2, and a second electrode of the third transistor M3 is electrically connected to a third node N3.

A gate electrode of the fourth transistor M4 is electrically connected to a first control signal line FB, a first electrode of the fourth transistor M4 is electrically connected to a sensing signal line SENSING, and a second electrode of the fourth transistor M4 is electrically connected to the second node N2.

A first plate of the storage capacitor C1 is electrically connected to the first node N1, and a second plate of the storage capacitor C1 is electrically connected to the second node N2.

A first electrode of the OLED element L1 is electrically connected to the third node N3, and a second electrode of the OLED element L1 is electrically connected to a second voltage signal line VSS.

In the OLED compensation circuit according to the exemplary embodiments of the present disclosure, the first transistor, under a control of the first scanning signal line SCAN1, is configured to transmit a data signal carried by the data signal line SOURCE to the first node N1. The second transistor, under a control of the first light-emitting signal line EMIT1, is configured to transmit a first voltage signal carried by the first voltage signal line VDD to the second node N2. The third transistor, as a driving transistor under a control of the first node N1, is configured to transmit a signal carried by the second node N2 to an anode of the OLED element. The fourth transistor, under a control of the first control signal line FB, is configured to transmit a sensing signal carried by the sensing signal line SENSING to the second node N2. The storage capacitor is configured to store a received voltage, and couple a voltage change on its second plate to its first plate, or alternatively configured to couple a voltage change on its first plate to its second plate.

Optionally, the first transistor M1, the second transistor M2, the third transistor M3 and the fourth transistor M4 may be PMOS transistors. In the exemplary embodiments of the present disclosure, PMOS transistors have simpler production processes and lower manufacture costs as compared to NMOS transistors.

Figure 2:
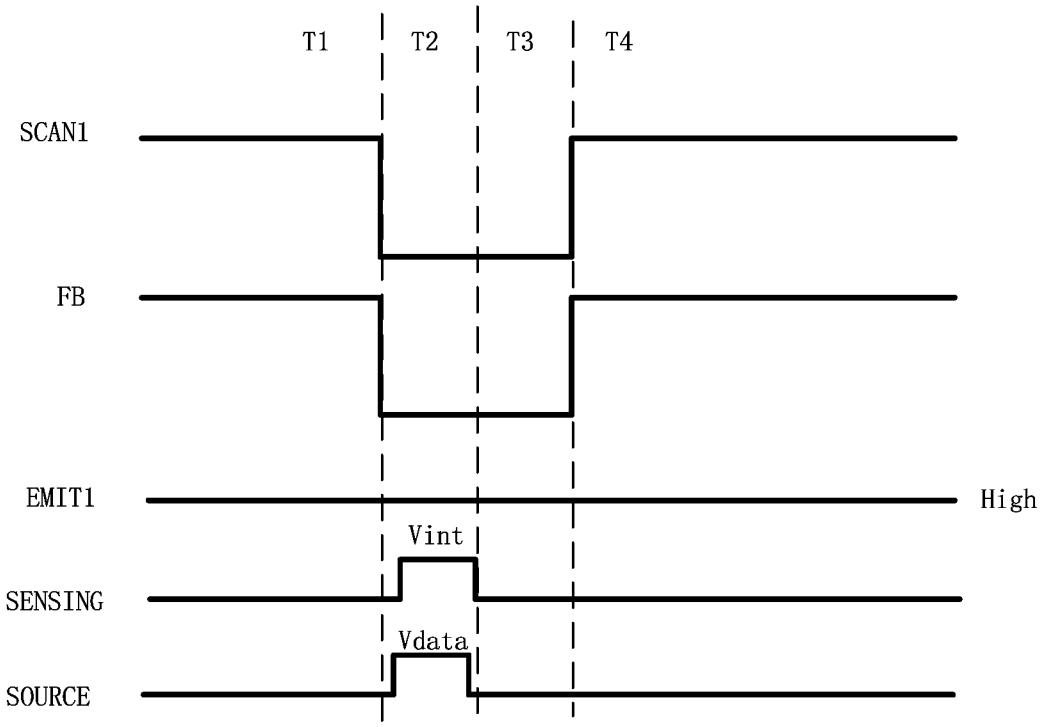
FIG. 2 illustrates a timing diagram of a driving signal configured to drive the exemplary OLED compensation circuit illustrated in FIG. 1 according to various embodiments of the present disclosure.

FIG. 2 is a timing diagram of a driving signal configured to drive the exemplary OLED compensation circuit illustrated in FIG. 1. It should be noted that the timing diagram as shown in FIG. 2, which corresponds to a case where the first transistor M1, the second transistor M2, the third transistor M3 and the fourth transistor M4 are PMOS transistors, is only for illustrative purposes.

With reference to FIG. 1 and FIG. 2, the working mechanism of the OLED compensation circuit during a compensation stage will be described in detail as follows.

Optionally in some exemplary embodiments of the present disclosure, the compensation stage of the OLED compensation circuit may include a first stage T1, a second stage T2, a third stage T3 and a fourth stage T4.

During the first stage T1, a high voltage level signal is supplied to the first scanning signal line SCAN1, a high voltage level signal is supplied to the first control signal line FB, and a high voltage level signal is supplied to the first light-emitting control signal line EMIT1. During this stage, all transistors in the OLED compensation circuit are in cut-off state.

During the second stage T2, a low voltage level signal is supplied to the first scanning signal line SCAN1, a low voltage level signal is supplied to the first control signal line FB, and a high voltage level signal is supplied to the first light-emitting control signal line EMIT1. A sensing voltage signal is carried by the sensing signal line SENSING. During this stage, the OLED compensation circuit fulfills data write-in, in particular, the fourth transistor M4 is turned on to a conducting state, transmitting a sensing voltage signal Vint carried by the sensing signal line SENSING to the second node N2. The first transistor is also turned on to a conducting state, transmitting a data signal Vdata carried by the data signal line SOURCE to the first node N1, where Vint>Vdata.

During the third stage T3, a low voltage level signal is supplied to the first scanning signal line SCAN1, a low voltage level signal is supplied to the first control signal line FB, and a high voltage level signal is supplied to the first light-emitting control signal line EMIT1. The sensing signal line SENSING is in a high impedance state. By then, a threshold voltage of the third transistor M3 may be detected. In particular, the second node N2 has a voltage of Vint and the first node N1 has a voltage of Vdata (Vint>Vdata), that is, a voltage of the gate electrode of the third transistor M3 is lower than a voltage of the source electrode, and the third transistor is turned on to a conducting state. The sensing signal line SENSING is in the high impedance state without providing any electric signal. The voltage level of the second node N2 may gradually approach the threshold voltage value for turning on the third transistor M3 to a conducting state, until the voltage of the second node N2 becomes Vdata+|Vth|, where Vth is the threshold voltage of the third transistor M3. The fourth transistor M4 is turned on to a conducting state, and the sensing signal line SENSING detects the voltage of the second node N2. Since Vdata is known, the threshold voltage Vth of the third transistor M3 may be obtained accordingly. Hence, the detection of the threshold voltage of the third transistor M3 may be fulfilled.

During the fourth stage T4, a high voltage level signal is supplied to the first scanning signal line SCAN1, a high voltage level signal is supplied to the first control signal line FB, and a high voltage level signal is supplied to the first light-emitting control signal line EMIT1. During this stage, all transistors in the OLED compensation circuit are in cut-off state, and the compensation stage of the OLED compensation circuit is completed.

The exemplary embodiments of the present disclosure provide an OLED compensation circuit for external compensation, such that the threshold voltage Vth of the third transistor M3 may be detected during the compensation stage. When the OLED compensation circuit is in a display stage, the data signal Vdata carried by the data signal line SOURCE is a data signal after the compensation. During the display stage, it may prevent the influence in the light-emitting current of the OLED element caused by the threshold voltage drift of the third transistor M3, thereby improving the performance of the OLED compensation circuit.

Figure 3:
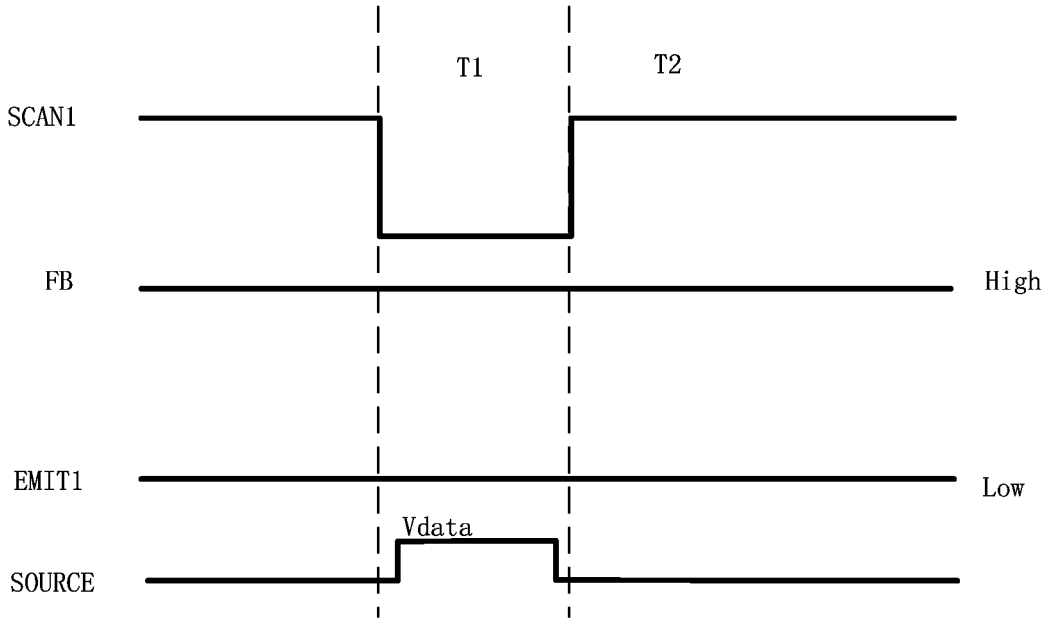
FIG. 3 illustrates a timing diagram of another driving signal configured to drive the exemplary OLED compensation circuit illustrated in FIG. 1 according to various embodiments of the present disclosure.

FIG. 3 illustrates a timing diagram of another driving signal configured to drive the OLED compensation circuit illustrated in FIG. 1. It should be noted that the timing diagram as shown in FIG. 3, which corresponds to a case where the first transistor M1, the second transistor M2, the third transistor M3 and the fourth transistor M4 are PMOS transistors, is only for illustrative purposes.

With reference to FIG. 1 and FIG. 3, the working mechanism of the OLED compensation circuit illustrated in FIG. 1 during the display stage will be described in detail as follows.

Optionally in some exemplary embodiments of the present disclosure, the display stage of the OLED compensation circuit may include a first stage T1 and a second stage T2.

During the first stage T1, a low voltage level signal is supplied to the first scanning signal line SCAN1, a high voltage level signal is supplied to the first control signal line FB, and a low voltage level signal is supplied to the first light-emitting control signal line EMIT1. During this first stage, the first transistor M1 is turned on to a conducting state under the control of the first scanning signal line SCAN1, transmitting the data signal Vdata carried by the data signal line SOURCE to the first node N1. The second transistor M2 is turned on to a conducting state under the control of the light-emitting control signal line EMIT1, transmitting the first voltage signal Vdd carried by the first voltage signal line VDD to the second node N2, where Vdd>Vdata.

During the second stage T2, a high voltage level signal is supplied to the first scanning signal line SCAN1, a high voltage level signal is supplied to the first control signal line FB, and a low voltage level signal is supplied to the first light-emitting control signal line EMIT1. During this stage, the second node N2 has a voltage of Vdd and the first node N1 has a voltage of Vdata, where Vdd>Vdata. That is, the voltage of the gate electrode of the third transistor M3 is lower than the voltage of its source electrode, and the third transistor M3 is turned on to a conducting state. The first voltage signal Vdd carried by the first voltage signal line VDD is transmitted to the anode of the OLED element L1, driving the OLED element L1 to emit light.

It should be noted that the OLED compensation circuit as shown in FIG. 1 has the function of compensating the threshold voltage, and the threshold voltage Vth of the third transistor M3 may be detected during the compensation stage. Accordingly, during the display stage, the data signal Vdata carried by the data signal line SOURCE is a data signal after the compensation. During the display stage, it may prevent any influence in the light-emitting current of the OLED element caused by the threshold voltage drift of the third transistor M3, thereby improving the performance of the OLED compensation circuit.

Figure 4:
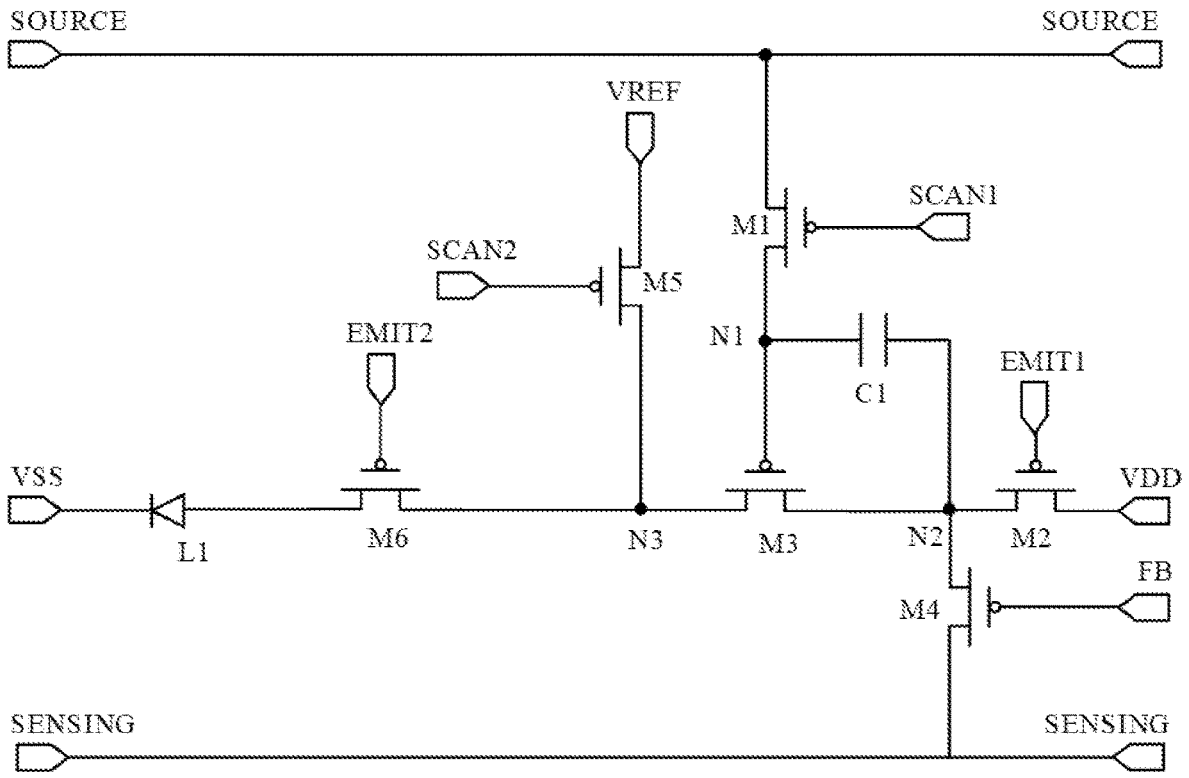
FIG. 4 illustrates a circuit schematic diagram of another exemplary OLED compensation circuit according to various embodiments of the present disclosure.

With reference to FIG. 4, it illustrates a circuit schematic diagram of another exemplary OLED compensation circuit according to some optional embodiments of the present disclosure, where the exemplary OLED compensation circuit may further include a fifth transistor M5 and a sixth transistor M6.

A gate electrode of the fifth transistor M5 is electrically connected to a second scanning signal line SCAN2, a first electrode of the fifth transistor M5 is electrically connected to a reference voltage signal line VREF, and a second electrode of the fifth transistor M5 is electrically connected to the third node N3. A gate electrode of the sixth transistor M6 is electrically connected to a second light-emitting control signal line EMIT2, a first electrode of the sixth transistor M6 is electrically connected to the third node N3, and a second electrode of the sixth transistor M6 is electrically connected to the anode of the OLED element L1.

The fifth transistor M5, under the control of the second scanning signal line SCAN2, is configured to transmit a reference voltage signal carried by the reference voltage signal line VREF to the third node N3. The sixth transistor M6, under the control of the second light-emitting control signal line EMIT2, is configured to transmit a signal carried by the third node N3 to the anode of the OLED element L1.

Optionally, the first transistor M1, the second transistor M2, the third transistor M3 and the fourth transistor M4 are PMOS transistors. Optionally, the fifth transistor M5 and the sixth transistor M6 are also PMOS transistors.

Figure 5:
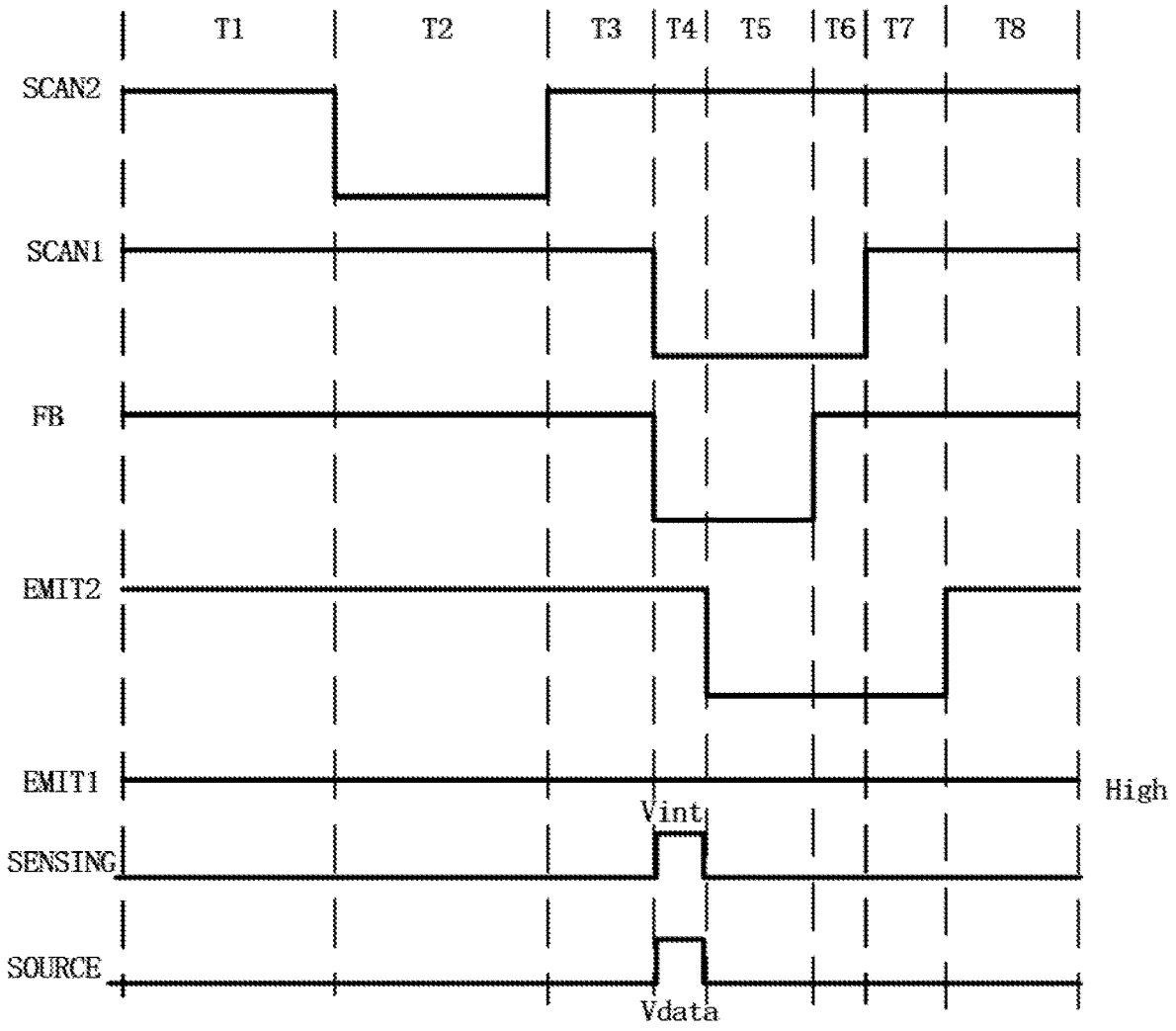
FIG. 5 illustrates a timing diagram of a driving signal configured to drive the exemplary OLED compensation circuit illustrated in FIG. 4 according to various embodiments of the present disclosure.

FIG. 5 illustrates a timing diagram of a driving signal configured to drive the exemplary OLED compensation circuit illustrated in FIG. 4. It should be noted that the timing diagram as shown in FIG. 5, which corresponds to a case where the first transistor M1, the second transistor M2, the third transistor M3, the fourth transistor M4, the fifth transistor M5 and the sixth transistor M6 are PMOS transistors, is only for illustrative purposes.

With reference to FIG. 4 and FIG. 5, the working mechanism of the OLED compensation circuit during the compensation stage will be described in detail as follows.

Optionally in some exemplary embodiments of the present disclosure, the compensation stage of the OLED compensation circuit may include: a first stage T1, a second stage T2, a third stage T3, a fourth stage T4, a fifth stage T5, a sixth stage T6, a seventh stage T7 and an eighth stage T8.

During the first stage T1, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, all transistors in the OLED compensation circuit are in cut-off state.

During the second stage T2, a high voltage level signal is supplied to the first scanning signal line SCAN1, a low voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, the fifth transistor M5 is turned on to a conducting state under the control of the second scanning signal line SCAN2, transmitting a reference voltage Vref carried by the reference voltage signal line VREF to the third node N3, thereby resetting the third node N3.

During the third stage T3, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, the second scanning signal line SCAN2 restores a high voltage level signal, thereby terminating the controlling of the third transistor M3. All transistors in the OLED compensation circuit are in cut-off state.

During the fourth stage T4, a low voltage level signal is supplied to the first scanning signal line SCAN1, a high voltage level signal is supplied to the second scanning signal line SCAN2, a low voltage level signal is supplied to the first control signal line FB, a high voltage level signal is supplied to the second light-emitting control signal line EMIT2, and a high voltage level signal is supplied to the first light-emitting control signal line EMIT1. During this stage, the OLED compensation circuit fulfills data write-in, in particular, the fourth transistor M4 is turned on to a conducting state, transmitting a sensing voltage signal Vint carried by the sensing signal line SENSING to the second node N2. The first transistor M1 is also turned on to a conducting state, transmitting a data signal Vdata carried by the data signal line SOURCE to the first node N1, where Vint>Vdata.

During the fifth stage T5, a low voltage level signal is supplied to the first scanning signal line SCAN1, a high voltage level signal is supplied to the second scanning signal line SCAN2, a low voltage level signal is supplied to the first control signal line FB, a low voltage level signal is supplied to the second light-emitting control signal line EMIT2, and a high voltage level signal is supplied to the first light-emitting control signal line EMIT1. During this stage, the sixth transistor M6 is turned on to a conducting state under the control of the second light-emitting control signal line EMIT2. By then, the threshold voltage of the third transistor may be detected. In particular, the second node N2 has a voltage of Vint and the first node N1 has a voltage of Vdata, where Vint>Vdata. That is, the voltage of the gate electrode of the third transistor M3 is lower than the voltage of its source electrode, and the third transistor M3 is turned on to a conducting state. The sensing signal line SENSING is in a high impedance state without providing any electric signal, the voltage level of the second node N2 may gradually approach the threshold voltage value for turning on the third transistor M3 to a conducting state, until the voltage of the second node N2 becomes Vdata+|Vth|, where Vth is the threshold voltage of the third transistor M3. The fourth transistor M4 is also turned on to a conducting state, and the sensing signal line SENSING detects the voltage of the second node N2. Since Vdata is known, the threshold voltage Vth of the third transistor M3 may be obtained. Hence, the detection of the threshold voltage of the third transistor M3 may be fulfilled.

During the sixth stage T6, a low voltage level signal is supplied to the first scanning signal line SCAN1, a high voltage level signal is supplied to the second scanning signal line SCAN2, a high voltage level signal is supplied to by the first control signal line FB, a low voltage level signal is supplied to the second light-emitting control signal line EMIT2, and a high voltage level signal is supplied to the first light-emitting control signal line EMIT1. During this stage, the first control signal line FB terminates the controlling of the fourth transistor M4, and the sensing signal line SENSING terminates the detection of the threshold voltage of the third transistor M3.

During the seventh stage T7, a high voltage level signal is supplied to the first scanning signal line SCAN1, a high voltage level signal is supplied to by the second scanning signal line SCAN2, a high voltage level signal is supplied to the first control signal line FB, a low voltage level signal is supplied to the second light-emitting control signal line EMIT2, and a high voltage level signal is supplied to the first light-emitting control signal line EMIT1. During this stage, the first scanning signal line SCAN1 terminates the controlling of the first transistor M1.

During the eighth stage T8, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, the second light-emitting control signal line EMIT2 terminates the controlling of the sixth transistor M6. By then, the compensation stage of the OLED compensation circuit according to the exemplary embodiments of the present disclosure is completed and the detection of the threshold voltage Vth of the third transistor M3 is fulfilled.

The exemplary embodiments of the present disclosure provide the OLED compensation circuit for external compensation, and the threshold voltage Vth of the third transistor M3 may be detected during the compensation stage. When the OLED compensation circuit is in a display stage, the data signal Vdata carried by the data signal line SOURCE is a data signal after the compensation. During the display stage, it may prevent any influence in the light-emitting current of the OLED element caused by the threshold voltage drift of the third transistor M3, thereby improving the performance of the OLED compensation circuit. In addition, the OLED compensation circuit in some exemplary embodiments of the present disclosure may further include the fifth transistor M5 and the sixth transistor M6. The fifth transistor M5, under the control of the second canning signal line SCAN2, may be configured to reset the third node N3. That is, to reset the anode of the OLED element L1, thereby improving the performance of the OLED compensation circuit. The sixth transistor M6, under the control of the second light-emitting control signal line EMIT2, may be configured to adjust the light-emitting time of the OLED element by controlling the duty cycle of the signal carried by the second light-emitting control signal line EMIT2 during the display stage.

Figure 6:
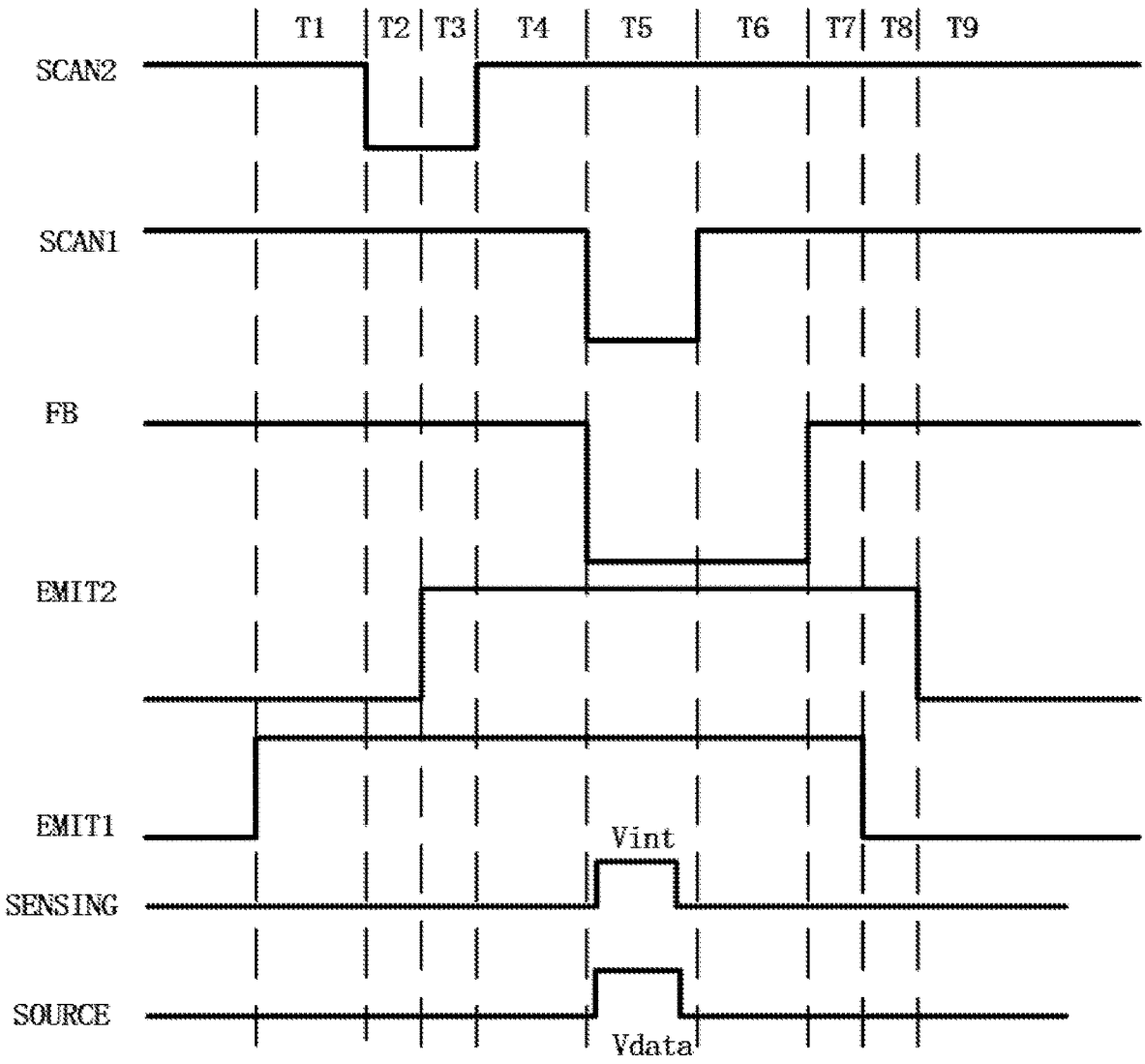
FIG. 6 illustrates a timing diagram of another driving signal configured to drive the exemplary OLED compensation circuit illustrated in FIG. 4 according to various embodiments of the present disclosure.

FIG. 6 is a timing diagram of another driving signal configured to drive the exemplary OLED compensation circuit illustrated in FIG. 4. It should be noted that the timing diagram as shown in FIG. 6, which corresponds to a case where the first transistor M1, the second transistor M2, the third transistor M3, the fourth transistor M4, the fifth transistor M5 and the sixth transistor M6 are PMOS transistors, is only for illustrative purposes.

With reference to FIG. 4 and FIG. 6, the working mechanism of the OLED compensation circuit during the display stage will be described in detail as follows.

Optionally in some exemplary embodiments of the present disclosure, the display stage of the OLED compensation circuit may include: a first stage T1, a second stage T2, a third stage T3, a fourth stage T4, a fifth stage T5, a sixth stage T6, a seventh stage T7, an eighth stage T8 and a ninth stage T9.

During the first stage T1, a high voltage level signal is supplied to the first scanning signal line SCAN1, a high voltage level signal is supplied to the second scanning signal line SCAN2, a high voltage level signal is supplied to the first control signal line FB, a low voltage level signal is supplied to the second light-emitting control signal line EMIT2, and a high voltage level signal is supplied to the first light-emitting control signal line EMIT1. During this stage, the sixth transistor M6 is turned on to a conducting state under the control of the second light-emitting control signal line EMIT2, while all the other transistors are in cut-off state.

During the second stage T2, a high voltage level signal is supplied to the first scanning signal line SCAN1, a low voltage level signal is supplied to the second scanning signal line SCAN2, a high voltage level signal is supplied to the first control signal line FB, a low voltage level signal is supplied to the second light-emitting control signal line EMIT2, and a high voltage level signal is supplied to the first light-emitting control signal line EMIT1. During this stage, the fifth transistor M5 is turned on to a conducting state under the control of the second scanning signal line SCAN2, transmitting a reference voltage Vref carried by the reference voltage signal line VREF to the third node N3, thereby resetting the third node N3.

During the third stage T3, a high voltage level signal is supplied to the first scanning signal line SCAN1, a low voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, the second light-emitting control signal line EMIT2 terminates the controlling of the sixth transistor M6.

During the fourth stage T4, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, all transistors are in cut-off state.

During the fifth stage T5, a low voltage level signal is supplied to the first scanning signal line SCAN1, a high voltage level signal is supplied to the second scanning signal line SCAN2, a low voltage level signal is supplied to the first control signal line FB, a high voltage level signal is supplied to the second light-emitting control signal line EMIT2, and a high voltage level signal is supplied to the first light-emitting control signal line EMIT1. During this stage, the OLED compensation circuit fulfills data write-in, in particular, the fourth transistor M4 is turned on to a conducting state under the control of the first control signal line FB, transmitting a sensing voltage signal Vint carried by the sensing signal line SENSING to the second node N2. The first transistor M1 is turned on to a conducting state under the control of the first scanning signal line SCAN1, transmitting a data signal Vdata carried by the data signal line SOURCE to the first node N1 where Vint>Vdata. Since the second node N2 has a voltage of Vint and the first node N1 has a voltage of Vdata where Vint>Vdata, that is, the voltage of the gate electrode of the third transistor M3 is lower than the voltage of its source electrode. The third transistor is turned on to a conducting state.

During the sixth stage T6, a high voltage level signal is supplied to the first scanning signal line SCAN1, a high voltage level signal is supplied to the second scanning signal line SCAN2, a low voltage level signal is supplied to the first control signal line FB, a high voltage level signal is supplied to the second light-emitting control signal line EMIT2, and a high voltage level signal is supplied to the first light-emitting control signal line EMIT1. During this stage, the first scanning signal line SCAN1 terminates the controlling of the first transistor M1, and the data signal Vdata carried by the data signal line SOUCR terminates the data write-in. The third transistor M3 remains the conducting state under the function of the storage capacitor.

During the seventh stage T7, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a high voltage level signal is supplied to the first light-emitting control signal line EMIT1. During this stage, the first control signal line FB terminates the controlling of the fourth transistor M4, and the sensing voltage signal Vint carried by the sensing signal line SENSING terminates the data write-in. The third transistor M3 remains the conducting state under the function of the storage capacitor.

During the eighth stage T8, a high voltage level signal is supplied to the first scanning signal line SCAN1, a high voltage level signal is supplied to the second scanning signal line SCAN2, a high voltage level signal is supplied to the first control signal line FB, a high voltage level signal is supplied to the second light-emitting control signal line EMIT2, and a low voltage level signal is supplied to the first light-emitting control signal line EMIT1. During this stage, the second transistor M2 is turned on to a conducting state under the control of the first light-emitting control signal line EMIT1, and the third transistor M3 remains the conducting state under the function of the storage capacitor, transmitting the first voltage signal Vdd carried by the first voltage signal line VDD to the second node N2 and the third node N3.

During the ninth stage T9, a high voltage level signal is supplied to the first scanning signal line SCAN1, a high voltage level signal is supplied to the second scanning signal line SCAN2, a high voltage level signal is supplied to the first control signal line FB, a low voltage level signal is supplied to the second light-emitting control signal line EMIT2, and a low voltage level signal is supplied to the first light-emitting control signal line EMIT1. During this stage, the sixth transistor M6 is turned on to a conducting state under the control of the second light-emitting control signal line EMIT2, transmitting the first voltage signal Vdd carried by the first voltage signal line VDD to the anode of the OLED element L1, and driving the OLED element L1 to emit light.

It should be noted that the OLED compensation circuit disclosed in the exemplary embodiments of the present disclosure has the function of compensating the threshold voltage, and the threshold voltage Vth of the third transistor M3 may be detected during the compensation stage. When the OLED compensation circuit is in the display stage, the data signal Vdata carried by the data signal line SOURCE is a data signal after the compensation. During the display stage, it may prevent any influence in the light-emitting current of the OLED element caused by the threshold voltage drift of the third transistor M3, thereby improving the performance of the OLED compensation circuit. Furthermore, the light-emitting time of the OLED element may be adjusted, by controlling the duty cycle of the signal carried by the second light-emitting control signal line EMIT2 during the display stage, thereby meeting various usage needs.

Figure 7:
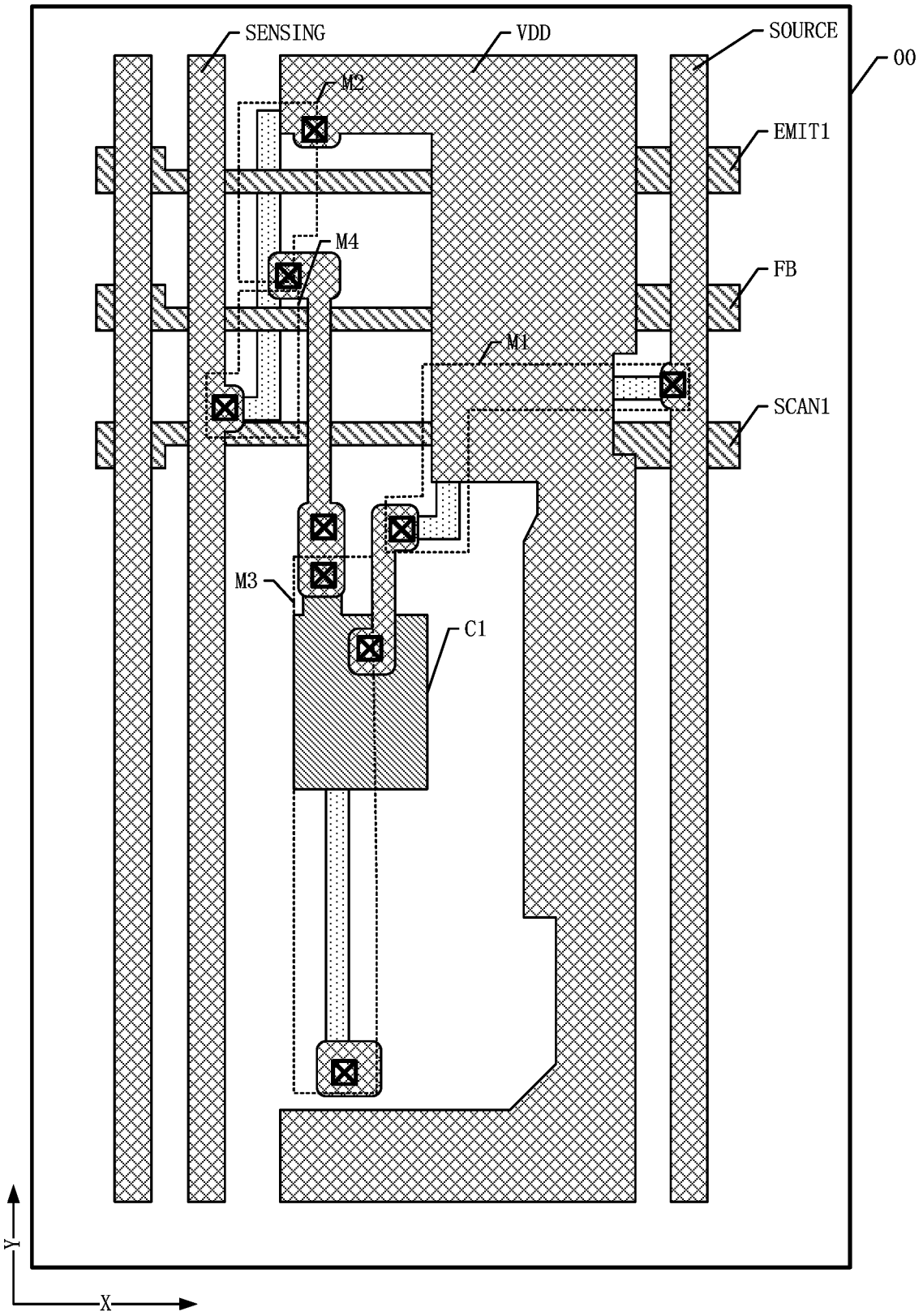
FIG. 7 illustrates a structural schematic diagram of partial region of an exemplary OLED display panel according to embodiments of the present disclosure.
Figure 8:
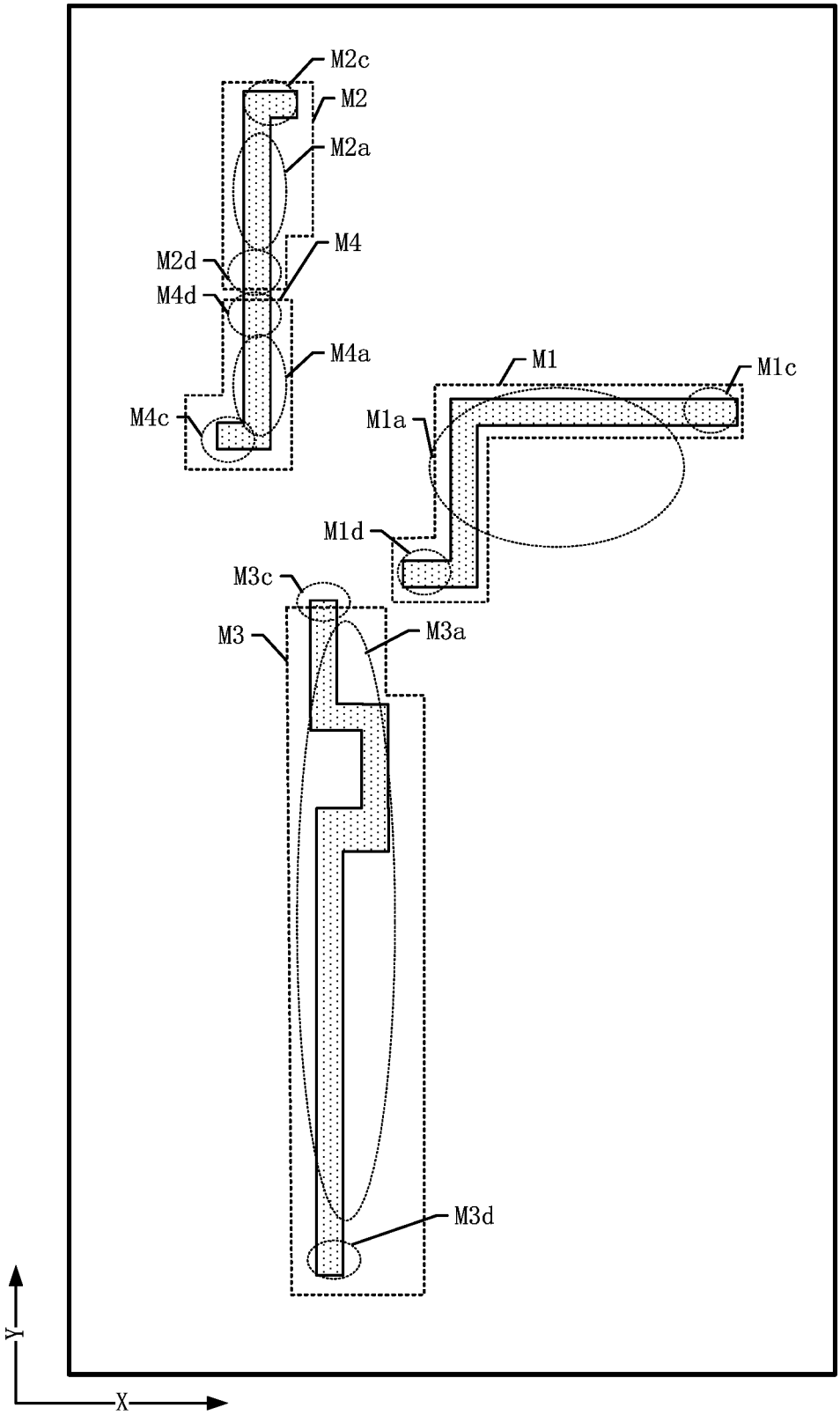
FIG. 8 illustrates a structural schematic diagram of a one-layer structure of the exemplary OLED display panel illustrated in FIG. 7 according to various embodiments of the present disclosure.
Figure 9:
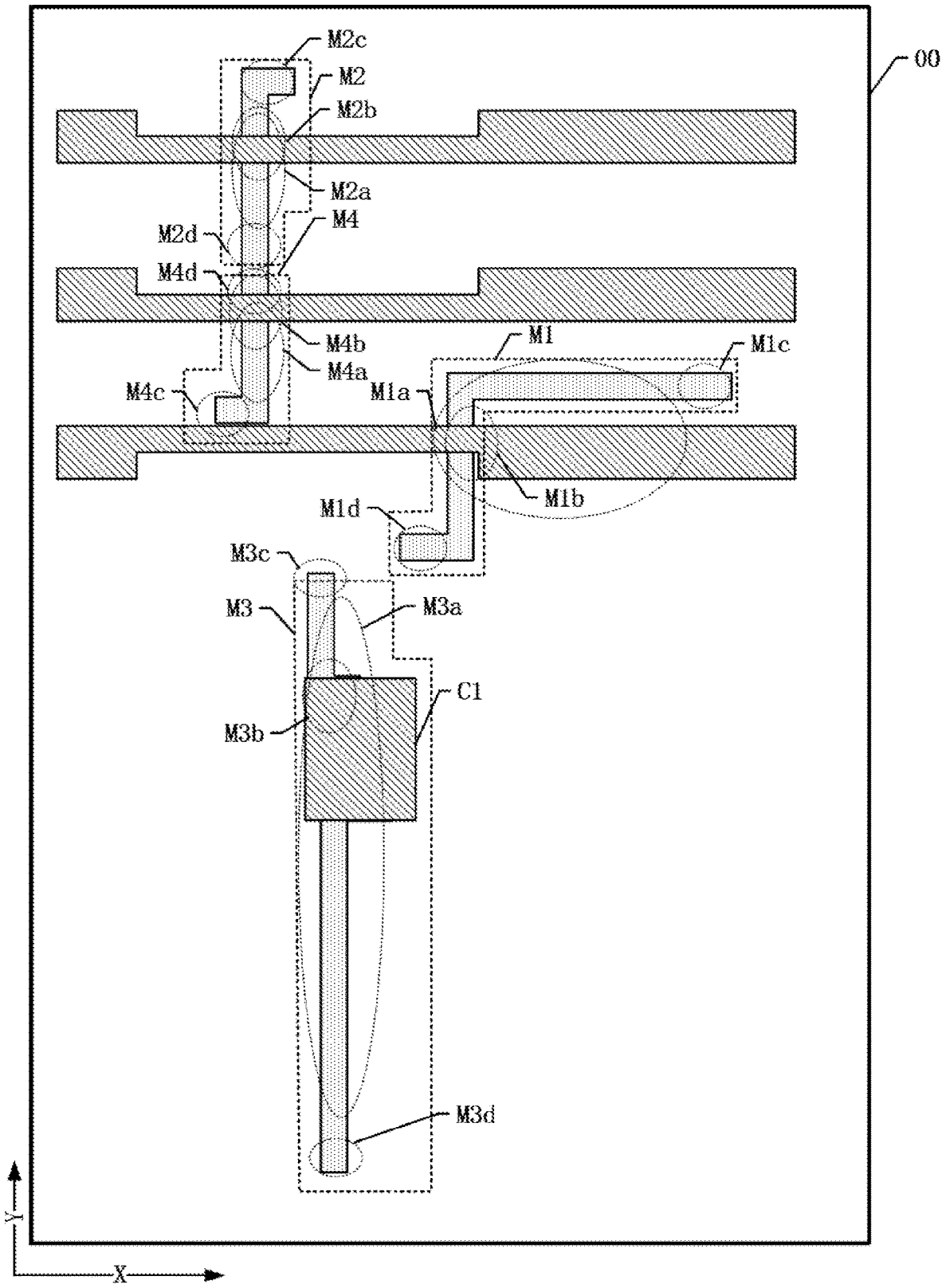
FIG. 9 illustrates a structural schematic diagram of a two-layer structure of the exemplary OLED display panel illustrated in FIG. 7 according to various embodiments of the present disclosure.
Figure 10:
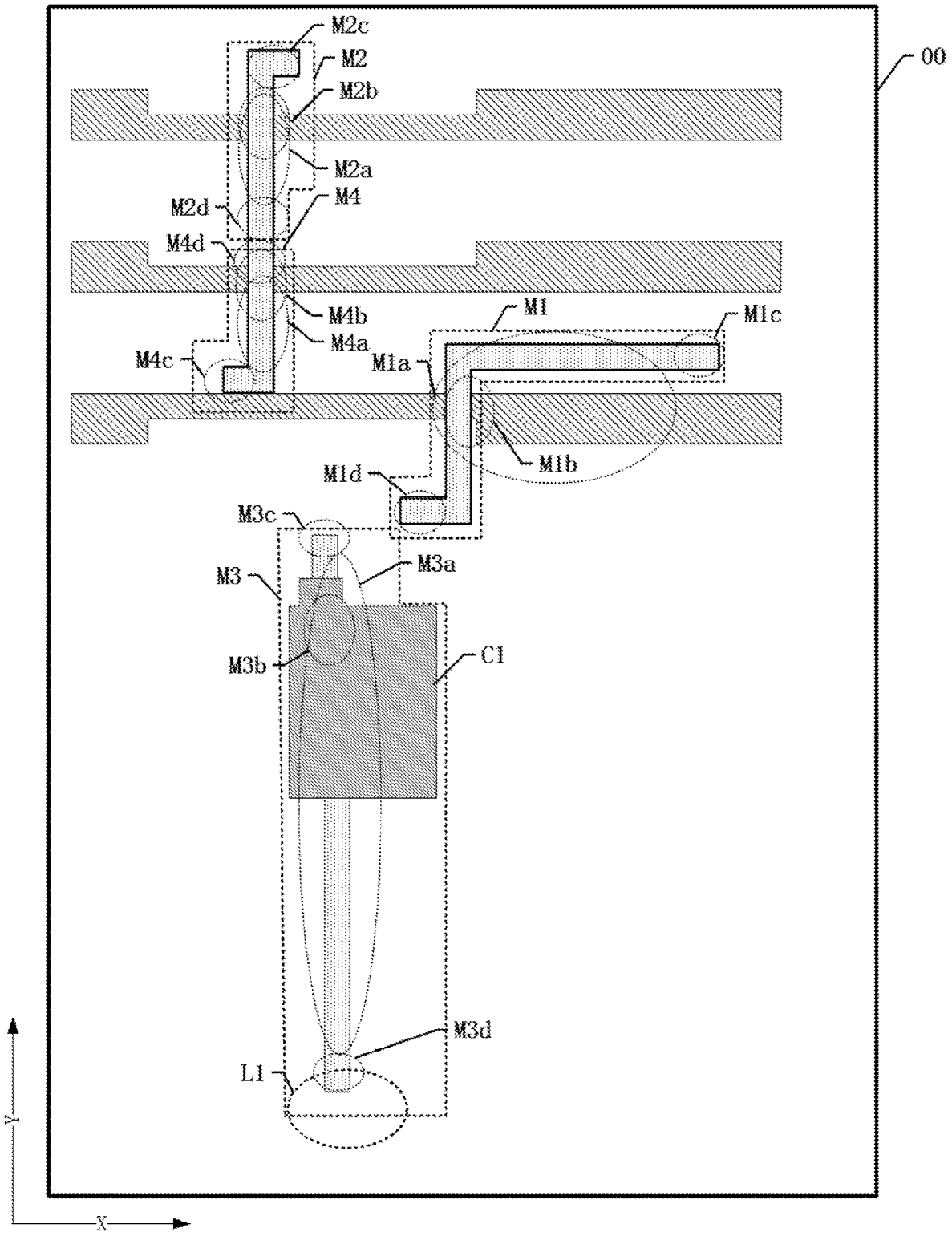
FIG. 10 illustrates a structural schematic diagram of a three-layer structure of the exemplary OLED display panel illustrated in FIG. 7 according to various embodiments of the present disclosure.

With references to FIGS. 7-10, FIG. 7 is a structural schematic diagram of partial region of an exemplary OLED display panel according to embodiments of the present disclosure. FIG. 8 illustrates a structural schematic diagram of the one-layer structure of the exemplary OLED display panel in FIG. 7. FIG. 9 illustrates a structural schematic diagram of a two-layer structures of the exemplary OLED display panel in FIG. 7. FIG. 10 illustrates a structural schematic diagram of a three-layer structure of the exemplary OLED display panel in FIG. 7. The exemplary embodiments of the present disclosure provide a display panel, including a substrate 00, a semiconductor layer Mla of a first transistor M1 disposed on the substrate 00, a semiconductor layer M2*a* of a second transistor M2 disposed on the substrate 00, a semiconductor layer M3*a* of a third transistor M3 disposed on the substrate 00, and a semiconductor layer M4*a* of a fourth transistor M4 disposed on the substrate 00.

A gate insulating layer covers the semiconductor layer Mla of the first transistor M1, the semiconductor layer M2*a* of the second transistor M2, the semiconductor layer M3*a* of the third transistor M3 and the semiconductor layer M4*a* of the fourth transistor M4.

A gate electrode Mlb of the first transistor M1 is disposed on the gate insulating layer and overlapped with the semiconductor layer M1*a* of the first transistor M1.

A gate electrode M2*b* of the second transistor M2 is disposed on the gate insulating layer and overlapped with the semiconductor layer M2*a* of the second transistor M2.

A gate electrode M3*b* of the third transistor M3 is disposed on the gate insulating layer and overlapped with the semiconductor layer M3*a* of the third transistor M3.

A gate electrode M4*b* of the fourth transistor M4 is disposed on the gate insulating layer and overlapped with the semiconductor layer M4*a* of the fourth transistor M4.

A first plate of a storage capacitor C1 is disposed on the substrate and overlapped with the gate electrode M3*b* of the third transistor M3.

An auxiliary insulating layer covers the gate electrode Mlb of the first transistor M1, the gate electrode M2*b* of the second transistor M2, the gate electrode M3*b* of the third transistor M3, the gate electrode M4*b* of the fourth transistor M4 and the first plate of the storage capacitor C1.

A second plate of the storage capacitor C1 is disposed on the substrate and overlapped with the first plate of the storage capacitor C1.

An interlayer insulating layer covers the second plate of the storage capacitor C1.

A first scanning signal line SCAN1 is disposed on the substrate, extending along a first direction X.

A data signal line SOURCE is disposed on the substrate, extending along a second direction Y, and the second direction Y intersects with the first direction X.

A first light-emitting controls signal line EMIT1 is disposed on the substrate, extending along the first direction X.

A first voltage signal line VDD is disposed on the substrate, extending along the second direction Y.

A first control signal line FB is disposed on the substrate, extending along the first direction X.

A sensing signal line SENSING is disposed on the substrate, extending along the second direction Y.

The gate electrode Mlb of the first transistor M1 is electrically connected to the first scanning signal line SCAN1, a first electrode Mlc of the first transistor M1 is electrically connected to the data signal line SOURCE, and a second electrode Mld of the first transistor M1 is electrically connected to the first plate of the storage capacitor C1.

The gate electrode M2*b* of the second transistor M2 is electrically connected to the first light-emitting controls signal line EMIT1, a first electrode M2*c* of the second transistor M2 is electrically connected to the first voltage signal line VDD, and a second electrode M2*d* of the second transistor M2 is electrically connected to the second plate of the storage capacitor C1.

The gate electrode M3*b* of the third transistor M3 is electrically connected to the first plate of the storage capacitor C1, and a first electrode M3*c* of the third transistor M3 is electrically connected to the second plate of the storage capacitor C1.

The gate electrode M4*b* of the fourth transistor M4 is electrically connected to the first control signal line FB, a first electrode M4*c* of the fourth transistor M4 is electrically connected to the sensing signal line SENSING, and a second electrode M4*d* of the fourth transistor M4 is electrically connected to the second plate of the storage capacitor C1.

With reference to FIG. 7 according to some of the optional exemplary embodiments of the present disclosure, the first scanning signal line SCAN1, the first light-emitting controls signal line EMIT1, the first control signal line FB and the first plate of the storage capacitor C1 are disposed on a first metal layer.

The data signal line SOURCE, the sensing signal line SENSING and the first voltage signal line VDD are disposed on a second metal layer.

The second plate of the storage capacitor C1 is disposed on an auxiliary metal layer.

Figure 11:
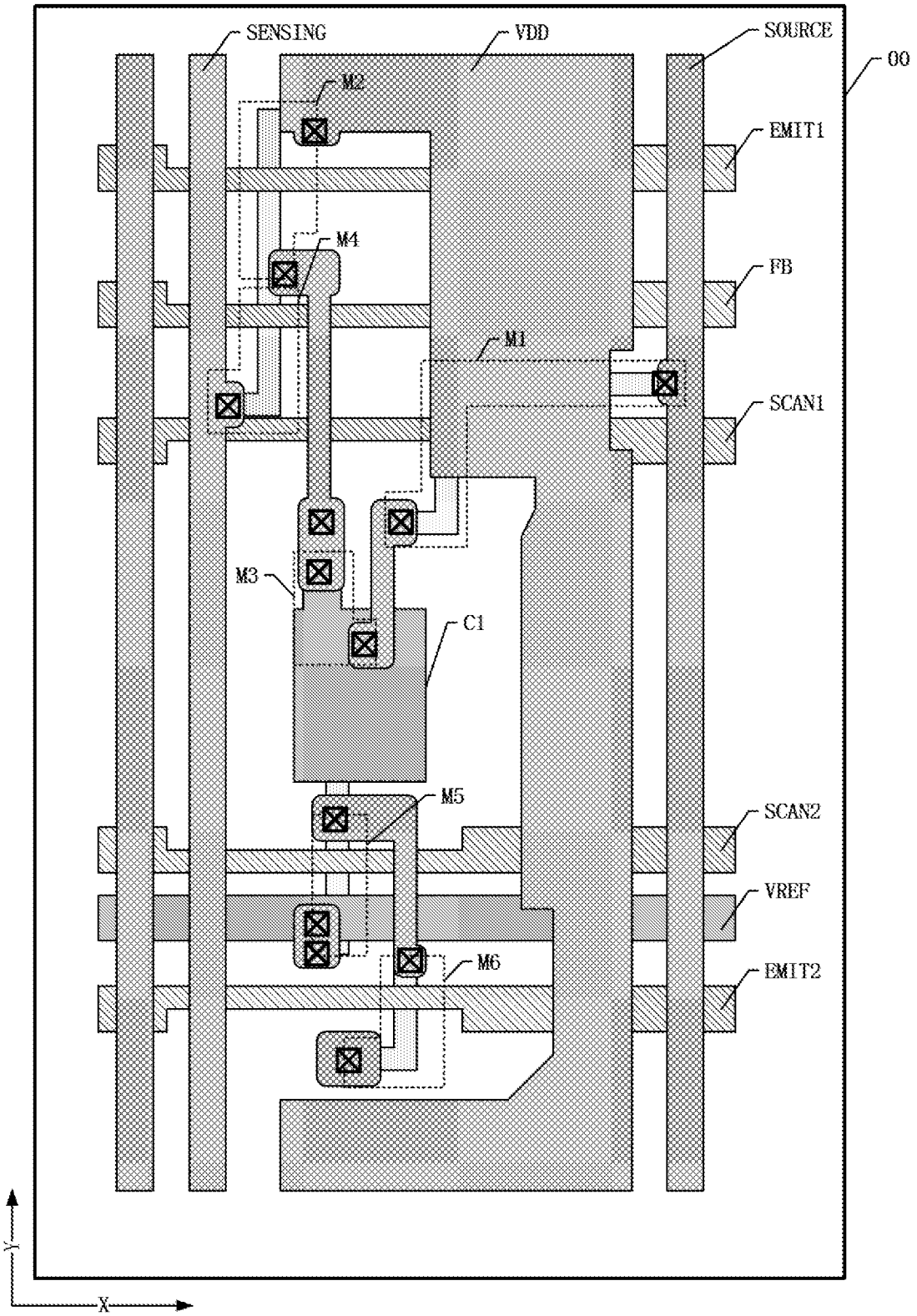
FIG. 11 illustrates a structural schematic diagram of partial region of another exemplary OLED display panel according to embodiments of the present disclosure.
Figure 12:
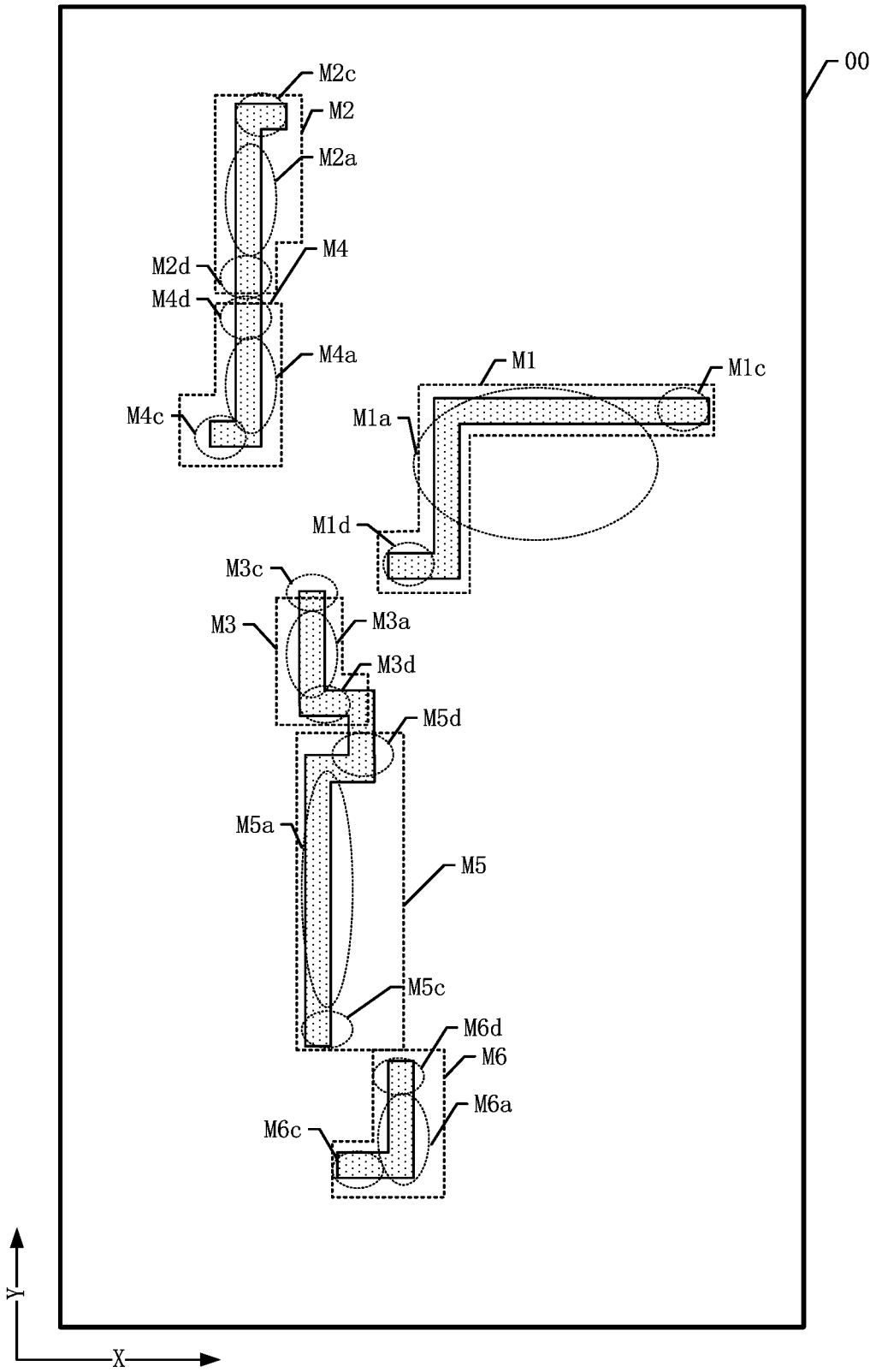
FIG. 12 illustrates a structural schematic diagram of the one-layer structure of the exemplary OLED display panel illustrated in FIG. 11.
Figure 13:
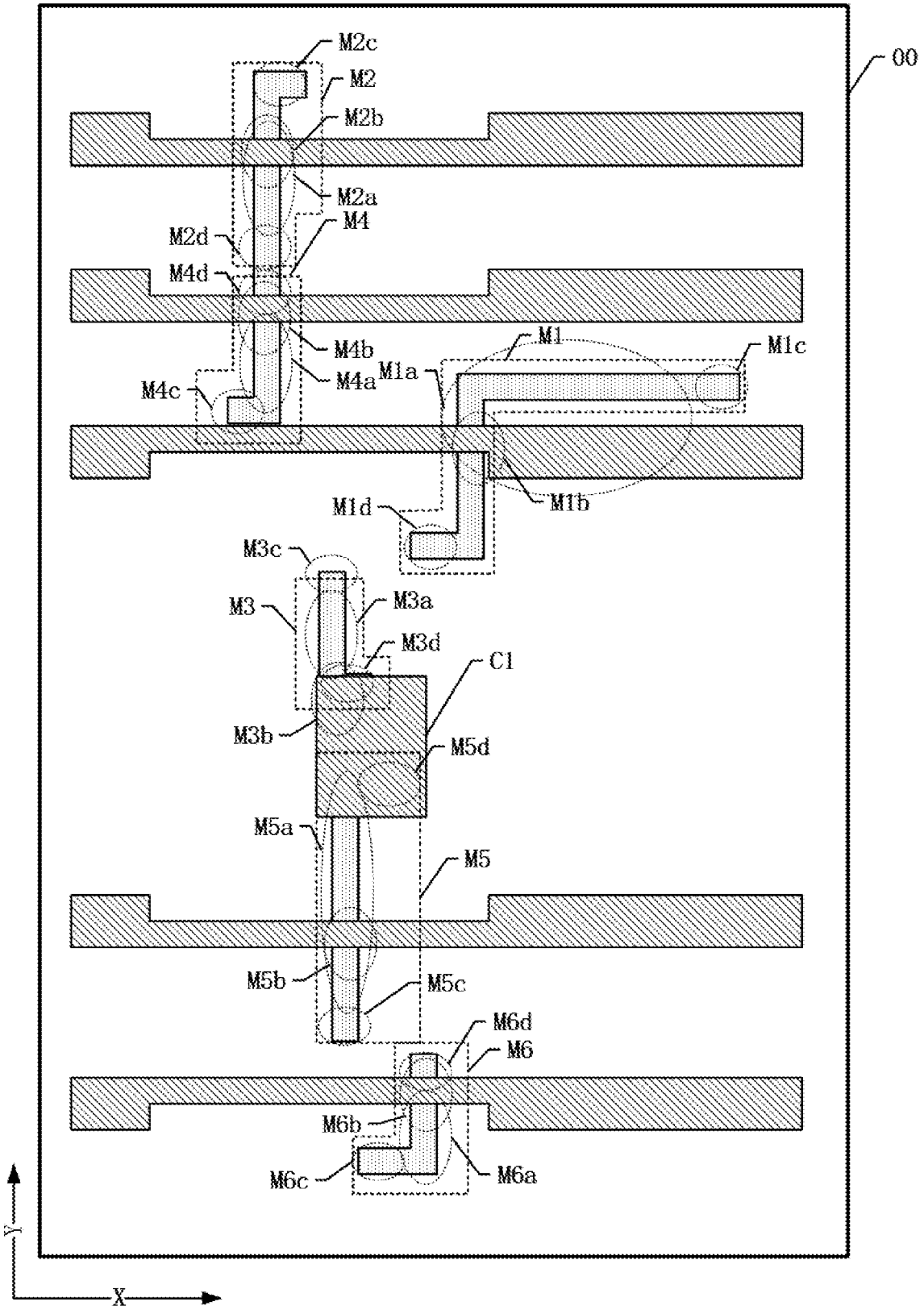
FIG. 13 illustrates a structural schematic diagram of a two-layer structure of the exemplary OLED display panel illustrated in FIG. 11.
Figure 14:
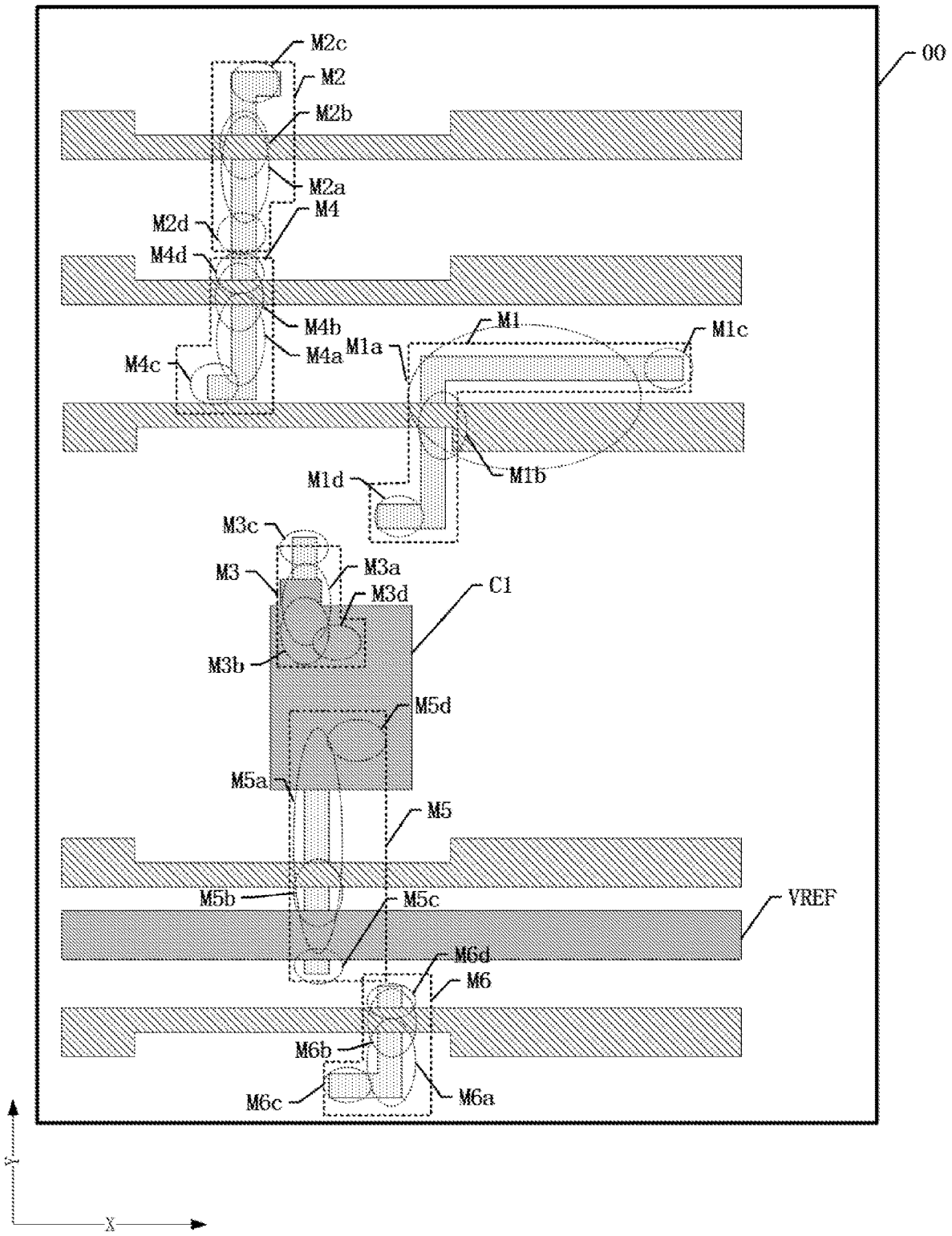
FIG. 14 illustrates a structural schematic diagram of a three-layer structure of the exemplary OLED display panel illustrated in FIG. 11.

With reference to FIGS. 11-14, FIG. 11 illustrates a structural schematic diagram of partial region of another exemplary OLED display panel according to the embodiments of the present disclosure. FIG. 12 illustrates a structural schematic diagram of the one-layer structure of the exemplary OLED display panel in FIG. 11. FIG. 13 illustrates a structural schematic diagram of a two-layer structure of the exemplary OLED display panel in FIG. 11. FIG. 14 illustrates a structural schematic diagram of a three-layer structure of the exemplary OLED display panel in FIG. 11. The OLED compensation circuit may further include a fifth transistor M5 and a sixth transistor M6.

A semiconductor layer M5*a* of the fifth transistor M5 is disposed on the substrate 00.

A semiconductor layer M6*a* of the sixth transistor M6 is disposed on the substrate 00.

The gate insulating layer covers the semiconductor layer M5*a* of the fifth transistor M5 and the semiconductor layer M6*a* of the sixth transistor M6.

A gate electrode M5*b* of the fifth transistor M5 is disposed on the gate insulating layer and overlapped with the semiconductor layer M5*a* of the fifth transistor M5.

A gate electrode M6*b* of the sixth transistor M6 is disposed on the gate insulating layer and overlapped with the semiconductor layer M6*a* of the sixth transistor M6.

The auxiliary insulating layer covers the gate electrode M5*b* of the fifth transistor M5 and the gate electrode M6*b* of the sixth transistor M6.

A second scanning signal line SCAN2 is disposed on the substrate, extending along the first direction X.

A reference voltage signal line VREF is disposed on the substrate, extending along the first direction X.

With reference to FIG. 11 according to some of the optional exemplary embodiments of the present disclosure, the second scanning signal line SCAN2 and the first scanning signal line SCAN1 are disposed on a same layer.

The reference voltage signal line VREF and the second plate of the storage capacitor C1 are disposed on a same layer.

Optionally referring to FIG. 11, the second plate of the storage capacitor C1 is disposed on the auxiliary metal layer, and the auxiliary metal layer is located between the first metal layer and the second metal layer.

Figure 15:
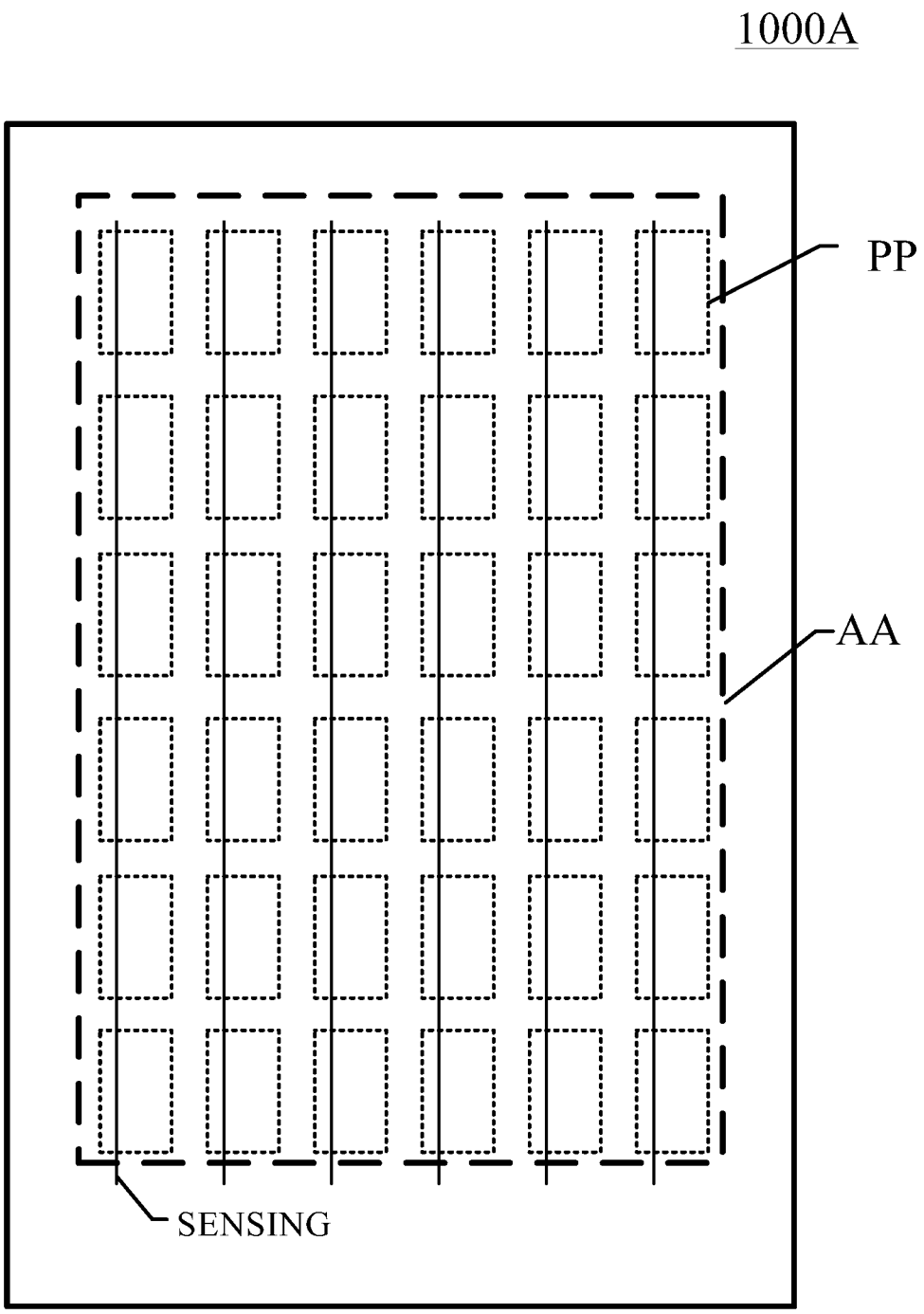
FIG. 15 illustrates a structural schematic diagram of another exemplary OLED display panel according to embodiments of the present disclosure.

With reference to FIG. 15 according to some of the optional exemplary embodiments of the present disclosure, it illustrates a structural schematic diagram of another exemplary OLED display panel. The exemplary OLED display panel 1000A may include: a plurality of sub-pixels PP arranged in a matrix, where each of the plurality of sub-pixels PP includes an OLED compensation circuit.

With reference to FIGS. 7-10, the OLED compensation circuit includes a first transistor M1, a second transistor M2, a third transistor M3, a fourth transistor M4, a storage capacitor C1 and an OLED element L1.

For each sub-pixel PP arranged in a same column, a first electrode Mlc of a first transistor M1 of each sub-pixel PP is electrically connected to a same sensing signal line SENSING.

Optionally, a display panel may include a display area AA, where the plurality of sub-pixels PP is arranged in the display area AA. For illustrative purposes only, the OLED compensation circuits 201 are arranged in an array as illustrated in FIG. 15. The embodiments of the present disclosure are not intended to limit the arrangements of the OLED compensation circuits 201 in a display panel in any manner.

The display panel described in the exemplary embodiments of the present disclosure may possess the beneficial effects of the OLED compensation circuits according to various embodiments of the present disclosure, referring to the corresponding explanations in the foregoing description. To avoid redundancy, it may not be further described herein.

Figure 16:
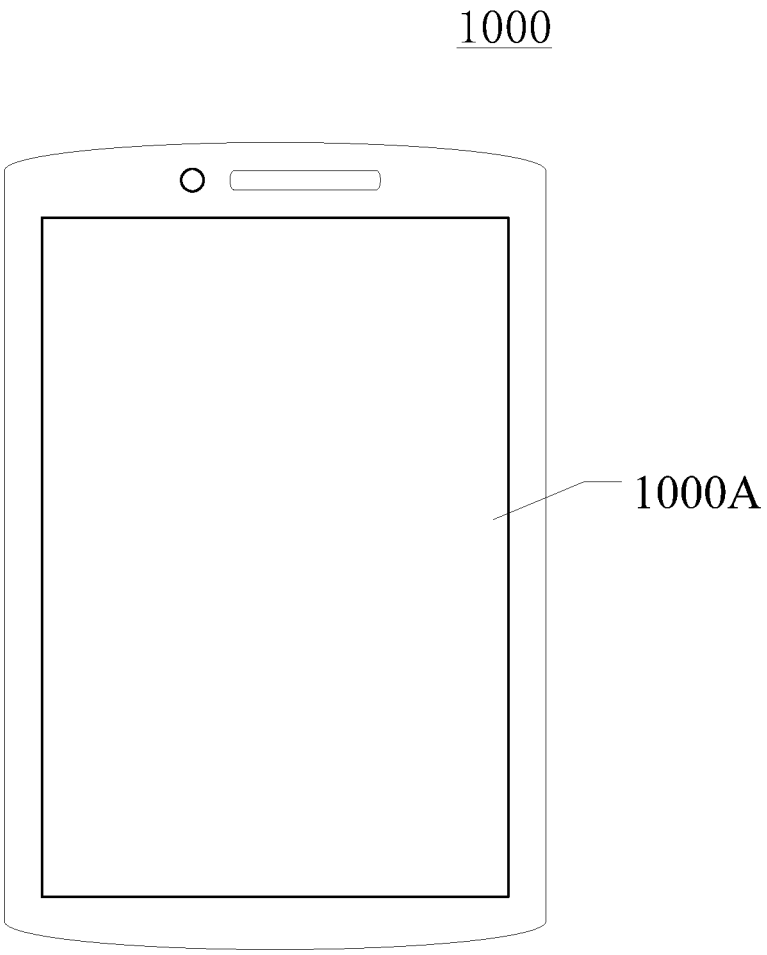
FIG. 16 illustrates a planar structural schematic diagram of an exemplary OLED display apparatus according to embodiments of the present disclosure.

An exemplary embodiment of the present disclosure provides a display apparatus, including a display panel according to various foregoing embodiments of the present disclosure. With reference to FIG. 16, it illustrates a planar structural schematic diagram of an exemplary OLED display apparatus according to the embodiments of the present disclosure. The OLED display apparatus 1000 may include a display panel 1000A described in any one of the foregoing embodiments of the present disclosure. A mobile phone illustrated in FIG. 16 is merely for exemplary purposes, to describe the display apparatus 1000. It should be understood that a display apparatus may include computers, televisions, vehicle display devices and other display apparatuses with display functions, not limited by the embodiments of the present disclosure. The display apparatus may possess the beneficial effects of the display panel according to various embodiments of the present disclosure, referring to the corresponding explanations in the foregoing description. To avoid redundancy, it may not be further described herein.

According to various embodiments of the present disclosure, an OLED compensation circuit, a display panel and a display apparatus may possess at least the beneficial effects listed in the following.

The OLED compensation circuit may possess the function of external compensation, and it may detect the threshold voltage of the third transistor during the compensation stage. When the OLED compensation circuit is in the display stage, the data signal carried by a data signal line is a data signal after the compensation. During the display stage, it may prevent any influence in the light-emitting current of the OLED element caused by the threshold voltage drift of the third transistor, thereby improving the performance of the OLED compensation circuit.

The disclosed OLED compensation circuit, display panel and display apparatus according to various embodiments of the present disclosure may achieve at least the beneficial effects listed in the following.

The OLED compensation circuit may possess the function of external compensation and may detect a threshold voltage of the third transistor during a compensation stage. When the OLED compensation circuit is during a display stage, the data signal carried by the data signal line is a data signal after the compensation. Additionally, during the display stage, the OLED compensation circuit may prevent any influence in the light-emitting current of the OLED element caused by the drift in the threshold voltage of the third transistor, thereby improving the performance of the OLED compensation circuit.

Apparently, it is unnecessary for any one of the various embodiments of the present disclosure to simultaneously achieve each of the beneficial effects as disclosed herein.

Although the present disclosure has been described in detail with reference to the foregoing embodiments, it is readily apparent to one with ordinary skill in the art that the foregoing embodiments as described are merely for explanatory purpose, and not intended to be limiting. It is also apparent to one with ordinary skill in the art that these embodiments may be modified or substituted, without departing from the scope of the various embodiments of the present disclosure. Instead, the scope of the present disclosure is defined by appended claims.

What is claimed is:

1. An organic light-emitting diode (OLED) compensation circuit comprising:

a first transistor;

a second transistor;

a third transistor;

a fourth transistor;

a fifth transistor;

a sixth transistor;

a storage capacitor; and an OLED element, wherein:

a gate electrode of the first transistor is electrically connected to a first scanning signal line, a first electrode of the first transistor is electrically connected to a data signal line, and a second electrode of the first transistor is electrically connected to a first node;

a gate electrode of the second transistor is electrically connected to a first light-emitting control signal line, a first electrode of the second transistor is electrically connected to a first voltage signal line, and a second electrode of the second transistor is electrically connected to a second node;

a gate electrode of the third transistor is electrically connected to the first node, a first electrode of the third transistor is electrically connected to the second node, and a second electrode of the third transistor is electrically connected to a third node;

a gate electrode of the fourth transistor is electrically connected to a first control signal line, a first electrode of the fourth transistor is electrically connected to a sensing signal line, and a second electrode of the fourth transistor is electrically connected to the second node;

a first plate of the storage capacitor is electrically connected to the first node, and a second plate of the storage capacitor is electrically connected to the second node;

a first electrode of the OLED element is electrically connected to the third node, and a second electrode of the OLED element is electrically connected to a second voltage signal line;

a gate electrode of the fifth transistor is electrically connected to a second scanning signal line, a first electrode of the fifth transistor is electrically connected to a reference voltage signal line, and a second electrode of the fifth transistor is electrically connected to the third node; and a gate electrode of the sixth transistor is electrically connected to a second light-emitting control signal line, a first electrode of the sixth transistor is electrically connected to the third node, and a second electrode of the sixth transistor is electrically connected to an anode of the OLED element.

2. The OLED compensation circuit according to claim 1, wherein:

the first transistor, the second transistor, the third transistor and the fourth transistor are PMOS transistors.

3. The OLED compensation circuit according to claim 2, wherein a compensation stage of the OLED compensation circuit comprises a first stage, a second stage, a third stage and a fourth stage, wherein:

during the first stage, a high voltage level signal is supplied to the first scanning signal line, a high voltage level signal is supplied to the first control signal line, and a high voltage level signal is supplied to the first light-emitting control signal line, during the second stage, a low voltage level signal is supplied to the first scanning signal line, a low voltage level signal is supplied to the first control signal line, and a high voltage level signal is supplied to the first light-emitting control signal line, and a sensing voltage signal is carried by the sensing signal line, during the third stage, a low voltage level signal is supplied to the first scanning signal line, a low voltage level signal is supplied to the first control signal line, and a high voltage level signal is supplied to the first light-emitting control signal line, and the sensing signal line is in a high impedance state, and during the fourth stage, a high voltage level signal is supplied to the first scanning signal line, a high voltage level signal is supplied to the first control signal line, and a high voltage level signal is supplied to the first light-emitting control signal line.

4. The OLED compensation circuit according to claim 2, wherein a display stage of the OLED compensation circuit comprises a first stage and a second stage, wherein:

during the first stage, a low voltage level signal is supplied to the first scanning signal line, a high voltage level signal is supplied to the first control signal line, and a low voltage level signal is supplied to the first light-emitting control signal line, and during the second stage, a high voltage level signal is supplied to the first scanning signal line, a high voltage level signal is supplied to the first control signal line, and a low voltage level signal is supplied to the first light-emitting control signal line.

5. The OLED compensation circuit according to claim 1, wherein:

the fifth transistor and the sixth transistor are PMOS transistors.

6. The OLED compensation circuit according to claim 5, wherein a compensation stage of the OLED compensation circuit comprises a first stage, a second stage, a third stage, a fourth stage, a fifth stage, a sixth stage, a seventh stage and an eighth stage, wherein:

during the first stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the second stage, a high voltage level signal is supplied to the first scanning signal line, a low voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the third stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the fourth stage, a low voltage level signal is supplied to the first scanning signal line, a high voltage level signal is supplied to the second scanning signal line, a low voltage level signal is supplied to the first control signal line, a high voltage level signal is supplied to the second light-emitting control signal line, and a high voltage level signal is supplied to the first light-emitting control signal line, during the fifth stage, a low voltage level signal is supplied to the first scanning signal line, a high voltage level signal is supplied to the second scanning signal line, a low voltage level signal is supplied to the first control signal line, a low voltage level signal is supplied to the second light-emitting control signal line, and a high voltage level signal is supplied to the first light-emitting control signal line, during the sixth stage, a low voltage level signal is supplied to the first scanning signal line, a high voltage level signal is supplied to the second scanning signal line, a high voltage level signal is supplied to the first control signal line, a low voltage level signal is supplied to the second light-emitting control signal line, and a high voltage level signal is supplied to the first light-emitting control signal line, during the seventh stage, a high voltage level signal is supplied to the first scanning signal line, a high voltage level signal is supplied to the second scanning signal line, a high voltage level signal is supplied to the first control signal line, a low voltage level signal is supplied to the second light-emitting control signal line, and a high voltage level signal is supplied to the first light-emitting control signal line, and during the eighth stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line.

7. The OLED compensation circuit according to claim 5, wherein a display stage of the OLED compensation circuit comprises a first stage, a second stage, a third stage, a fourth stage, a fifth stage, a sixth stage, a seventh stage, an eighth stage and a ninth stage, wherein:

during the first stage, a high voltage level signal is supplied to the first scanning signal line, a high voltage level signal is supplied to the second scanning signal line, a high voltage level signal is supplied to the first control signal line, a low voltage level signal is supplied to the second light-emitting control signal line, and a high voltage level signal is supplied to the first light-emitting control signal line, during the second stage, a high voltage level signal is supplied to the first scanning signal line, a low voltage level signal is supplied to the second scanning signal line, a high voltage level signal is supplied to the first control signal line, a low voltage level signal is supplied to the second light-emitting control signal line, and a high voltage level signal is supplied to the first light-emitting control signal line, during the third stage, a high voltage level signal is supplied to the first scanning signal line, a low voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the fourth stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the fifth stage, a low voltage level signal is supplied to the first scanning signal line, a high voltage level signal is supplied to the second scanning signal line, a low voltage level signal is supplied to the first control signal line, a high voltage level signal is supplied to the second light-emitting control signal line, and a high voltage level signal is supplied to the first light-emitting control signal line, during the sixth stage, a high voltage level signal is supplied to the first scanning signal line, a high voltage level signal is supplied to the second scanning signal line, a low voltage level signal is supplied to the first control signal line, a high voltage level signal is supplied to the second light-emitting control signal line, and a high voltage level signal is supplied to the first light-emitting control signal line, during the seventh stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a high voltage level signal is supplied to the first light-emitting control signal line, during the eighth stage, a high voltage level signal is supplied to the first scanning signal line, a high voltage level signal is supplied to the second scanning signal line, a high voltage level signal is supplied to the first control signal line, a high voltage level signal is supplied to the second light-emitting control signal line, and a low voltage level signal is supplied to the first light-emitting control signal line, and during the ninth stage, a high voltage level signal is supplied to the first scanning signal line, a high voltage level signal is supplied to the second scanning signal line, a high voltage level signal is supplied to the first control signal line, a low voltage level signal is supplied to the second light-emitting control signal line, and a low voltage level signal is supplied to the first light-emitting control signal line.

8. A display panel comprising:

a substrate;

a semiconductor layer of a first transistor disposed on the substrate;

a semiconductor layer of a second transistor disposed on the substrate;

a semiconductor layer of a third transistor disposed on the substrate;

a semiconductor layer of a fourth transistor disposed on the substrate;

a gate insulating layer covering the semiconductor layer of the first transistor, the semiconductor layer of the second transistor, the semiconductor layer of the third transistor and the semiconductor layer of the fourth transistor;

a gate electrode of the first transistor, disposed on the gate insulating layer and overlapped with the semiconductor layer of the first transistor;

a gate electrode of the second transistor, disposed on the gate insulating layer and overlapped with the semiconductor layer of the second transistor;

a gate electrode of the third transistor, disposed on the gate insulating layer and overlapped with the semiconductor layer of the third transistor;

a gate electrode of the fourth transistor, disposed on the gate insulating layer and overlapped with the semiconductor layer of the fourth transistor;

a first plate of a storage capacitor, disposed on the substrate and overlapped with the gate electrode of the third transistor;

an auxiliary insulating layer covering the gate electrode of the first transistor, the gate electrode of the second transistor, the gate electrode of the third transistor, the gate electrode of the fourth transistor and the first plate of the storage capacitor;

a second plate of the storage capacitor, disposed on the substrate and overlapped with the first plate of the storage capacitor;

an interlayer insulating layer covering the second plate of the storage capacitor;

a first scanning signal line disposed on the substrate, extending along a first direction;

a data signal line disposed on the substrate, extending along a second direction, wherein the second direction intersects with the first direction;

a first light-emitting control signal line disposed on the substrate, extending along the first direction;

a first voltage signal line disposed on the substrate, extending along the second direction;

a first control signal line disposed on the substrate, extending along the first direction; and a sensing signal line disposed on the substrate, extending along the second direction; wherein:

the gate electrode of the first transistor is electrically connected to the first scanning signal line, a first electrode of the first transistor is electrically connected to the data signal line, and a second electrode of the first transistor is electrically connected to the first plate of the storage capacitor, the gate electrode of the second transistor is electrically connected to the first light-emitting control signal line, a first electrode of the second transistor is electrically connected to the first voltage signal line, and a second electrode of the second transistor is electrically connected to the second plate of the storage capacitor, the gate electrode of the third transistor is electrically connected to the first plate of the storage capacitor and a first electrode of the third transistor is electrically connected to the second plate of the storage capacitor, and the gate electrode of the fourth transistor is electrically connected to the first control signal line, a first electrode of the fourth transistor is electrically connected to the sensing signal line, and a second electrode of the fourth transistor is electrically connected to the second plate of the storage capacitor.

9. The display panel according to claim 8, wherein:

the first scanning signal line, the first light-emitting control signal line, the first control signal line and the first plate of the storage capacitor are disposed on a first metal layer, the data signal line, the sensing signal line and the first voltage signal line are disposed on a second metal layer, and the second plate of the storage capacitor is disposed on an auxiliary metal layer.

10. The display panel according to claim 9, wherein:

the second plate of the storage capacitor is disposed on the auxiliary metal layer, and the auxiliary metal layer is located between the first metal layer and the second metal layer.

11. The display panel according to claim 8, further comprising a fifth transistor and a sixth transistor, wherein:

a semiconductor layer of the fifth transistor is disposed on the substrate, a semiconductor layer of the sixth transistor is disposed on the substrate, the gate insulating layer covers the semiconductor layer of the fifth transistor and the semiconductor layer of the sixth transistor, a gate electrode of the fifth transistor is disposed on the gate insulating layer and overlapped with the semiconductor layer of the fifth transistor, a gate electrode of the sixth transistor is disposed on the gate insulating layer and overlapped with the semiconductor layer of the sixth transistor, the auxiliary insulating layer covers the gate electrode of the fifth transistor and the gate electrode of the sixth transistor, a second scanning signal line, disposed on the substrate, extends along the first direction, and a reference voltage signal line, disposed on the substrate, extends along the first direction.

12. The display panel according to claim 11, wherein:

the second scanning signal line and the first scanning signal line are disposed on a same layer, and the reference voltage signal line and the second plate of the storage capacitor are disposed on a same layer.

13. The display panel according to claim 8, comprising a plurality of sub-pixels arranged in a matrix, wherein:

each of the plurality of sub-pixels includes an organic light-emitting diode (OLED) compensation circuit, the OLED compensation circuit includes the first transistor, the second transistor, the third transistor, the fourth transistor, the storage capacitor and an OLED element, and for each of the plurality of sub-pixels arranged in a same column, the first electrode of the first transistor is electrically connected to a same sensing signal line.

14. A display apparatus comprising a display panel, wherein the display panel comprises:

a substrate;

a semiconductor layer of a first transistor disposed on the substrate;

a semiconductor layer of a second transistor disposed on the substrate;

a semiconductor layer of a third transistor disposed on the substrate;

a semiconductor layer of a fourth transistor disposed on the substrate;

a gate insulating layer covering the semiconductor layer of the first transistor, the semiconductor layer of the second transistor, the semiconductor layer of the third transistor and the semiconductor layer of the fourth transistor;

a gate electrode of the first transistor, disposed on the gate insulating layer and overlapped with the semiconductor layer of the first transistor;

a gate electrode of the second transistor, disposed on the gate insulating layer and overlapped with the semiconductor layer of the second transistor;

a gate electrode of the third transistor, disposed on the gate insulating layer and overlapped with the semiconductor layer of the third transistor;

a gate electrode of the fourth transistor, disposed on the gate insulating layer and overlapped with the semiconductor layer of the fourth transistor;

a first plate of a storage capacitor, disposed on the substrate and overlapped with the gate electrode of the third transistor;

an auxiliary insulating layer covering the gate electrode of the first transistor, the gate electrode of the second transistor, the gate electrode of the third transistor, the gate electrode of the fourth transistor and the first plate of the storage capacitor;

a second plate of the storage capacitor, disposed on the substrate and overlapped with the first plate of the storage capacitor;

an interlayer insulating layer covering the second plate of the storage capacitor;

a first scanning signal line disposed on the substrate, extending along a first direction;

a data signal line disposed on the substrate, extending along a second direction, wherein the second direction intersects with the first direction;

a first light-emitting control signal line disposed on the substrate, extending along the first direction;

a first voltage signal line disposed on the substrate, extending along the second direction;

a first control signal line disposed on the substrate, extending along the first direction; and a sensing signal line disposed on the substrate, extending along the second direction; wherein:

the gate electrode of the first transistor is electrically connected to the first scanning signal line, a first electrode of the first transistor is electrically connected to the data signal line, and a second electrode of the first transistor is electrically connected to the first plate of the storage capacitor, the gate electrode of the second transistor is electrically connected to the first light-emitting control signal line, a first electrode of the second transistor is electrically connected to the first voltage signal line, and a second electrode of the second transistor is electrically connected to the second plate of the storage capacitor, the gate electrode of the third transistor is electrically connected to the first plate of the storage capacitor and a first electrode of the third transistor is electrically connected to the second plate of the storage capacitor, and the gate electrode of the fourth transistor is electrically connected to the first control signal line, a first electrode of the fourth transistor is electrically connected to the sensing signal line, and a second electrode of the fourth transistor is electrically connected to the second plate of the storage capacitor.

15. The display apparatus according to claim 14, wherein:

the display panel further includes a fifth transistor and a sixth transistor, a semiconductor layer of the fifth transistor is disposed on the substrate, a semiconductor layer of the sixth transistor is disposed on the substrate, the gate insulating layer covers the semiconductor layer of the fifth transistor and the semiconductor layer of the sixth transistor, a gate electrode of the fifth transistor is disposed on the gate insulating layer and overlapped with the semiconductor layer of the fifth transistor, a gate electrode of the sixth transistor is disposed on the gate insulating layer and overlapped with the semiconductor layer of the sixth transistor, the auxiliary insulating layer covers the gate electrode of the fifth transistor and the gate electrode of the sixth transistor, a second scanning signal line, disposed on the substrate, extends along the first direction, and a reference voltage signal line, disposed on the substrate, extends along the first direction.

16. The display apparatus according to claim 14, wherein:

the display panel includes a plurality of sub-pixels arranged in a matrix, each of the plurality of sub-pixels includes an organic light-emitting diode (OLED) compensation circuit, the OLED compensation circuit includes the first transistor, the second transistor, the third transistor, the fourth transistor, the storage capacitor and an OLED element, and for each of the plurality of sub-pixels arranged in a same column, the first electrode of the first transistor is electrically connected to a same sensing signal line.

* * * * *